US010363582B2

(12) United States Patent
Justice et al.

(10) Patent No.: US 10,363,582 B2
(45) Date of Patent: Jul. 30, 2019

(54) METHOD AND APPARATUS FOR SORTING

(71) Applicants: Timothy L. Justice, Walla Walla, WA (US); Johan Calcoen, Leuven (BE); Gerald R. Richert, Walla Walla, WA (US)

(72) Inventors: Timothy L. Justice, Walla Walla, WA (US); Johan Calcoen, Leuven (BE); Gerald R. Richert, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 0 days.

(21) Appl. No.: 15/791,261

(22) Filed: Oct. 23, 2017

(65) Prior Publication Data

US 2018/0056334 A1 Mar. 1, 2018

Related U.S. Application Data

(63) Continuation-in-part of application No. 14/997,173, filed on Jan. 15, 2016, now Pat. No. 9,795,996.

(51) Int. Cl.
*B07C 5/34* (2006.01)
*B07C 5/342* (2006.01)

(52) U.S. Cl.
CPC ..... *B07C 5/342* (2013.01); *B07C 5/34* (2013.01); *B07C 5/3422* (2013.01); *B07C 5/3425* (2013.01); *B07C 2501/0018* (2013.01); *B07C 2501/0081* (2013.01)

(58) Field of Classification Search
CPC ..... B07C 5/3425; B07C 5/3422; B07C 5/342; B07C 5/34; B07C 2501/0018; B07C 2501/0081
USPC ..... 209/576, 577
See application file for complete search history.

(56) References Cited

U.S. PATENT DOCUMENTS

| | | | |
|---|---|---|---|
| 4,369,886 | A | 1/1983 | Lane et al. |
| 4,834,870 | A | 5/1989 | Osterberg et al. |
| 5,471,311 | A | 11/1995 | van den Bergh et al. |
| 5,659,624 | A | 8/1997 | Fazzari et al. |
| 5,675,419 | A | 10/1997 | van den Bergh et al. |
| 5,761,070 | A | 6/1998 | Conners et al. |
| 5,954,206 | A | 9/1999 | Mallon et al. |
| 6,016,194 | A | 1/2000 | Girvin et al. |
| 6,060,677 | A | 5/2000 | Ulrichsen et al. |
| 6,734,383 | B1 | 5/2004 | Calcoen et al. |
| 7,292,949 | B2 | 11/2007 | Ding |

(Continued)

FOREIGN PATENT DOCUMENTS

| | | | |
|---|---|---|---|
| EP | 1083007 | A2 | 3/2001 |
| EP | 3210677 | A1 | 8/2017 |

OTHER PUBLICATIONS

European Search Report, Application No. 115811496.7, dated Nov. 17, 2017.
PCT International Search Report dated Aug. 17, 2015.

*Primary Examiner* — Terrell H Matthews
(74) *Attorney, Agent, or Firm* — Randall Danskin P.S.

(57) ABSTRACT

A method and apparatus for sorting objects is described, and which provides high-speed image data acquisition to fuse multiple data streams in real-time, while intentionally creating and utilizing known signal interference to enhance contrasts when individual sensors or detectors are utilized in providing data regarding features of a product to be inspected.

51 Claims, 18 Drawing Sheets

(56) References Cited

U.S. PATENT DOCUMENTS

| | | | | |
|---|---|---|---|---|
| 7,326,871 | B2 | 2/2008 | Kenny et al. | |
| 7,541,557 | B2 | 6/2009 | Voloshyn et al. | |
| 7,768,643 | B1 | 8/2010 | Janssens et al. | |
| 7,855,348 | B2 * | 12/2010 | Goodwin | G06K 9/2018 209/584 |
| 8,083,066 | B2 | 12/2011 | Bourely | |
| 8,253,054 | B2 | 8/2012 | Koehler et al. | |
| 8,283,589 | B2 | 10/2012 | Janssens et al. | |
| 8,794,447 | B2 | 8/2014 | Van Kasteren | |
| 8,902,416 | B2 | 12/2014 | Klokkerud et al. | |
| 9,795,996 | B2 * | 10/2017 | Adams | B07C 5/3425 |
| 2012/0138514 | A1 * | 6/2012 | Janssens | B07C 5/342 209/577 |
| 2014/0061103 | A1 | 3/2014 | Ito et al. | |
| 2016/0025644 | A1 * | 1/2016 | Nygaard | G01N 21/909 356/625 |
| 2016/0252461 | A1 | 9/2016 | Balthasar et al. | |
| 2018/0056334 | A1 * | 3/2018 | Justice | B07C 5/34 |

* cited by examiner

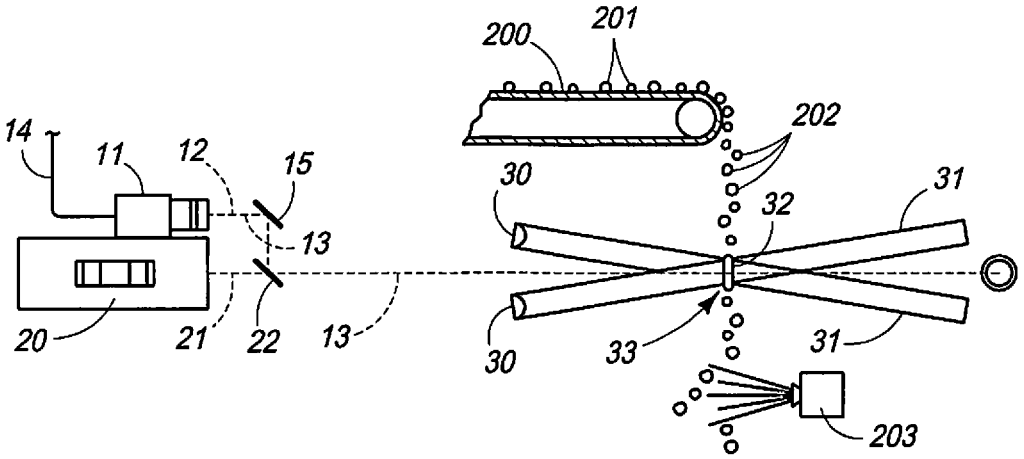
FIG. 1E
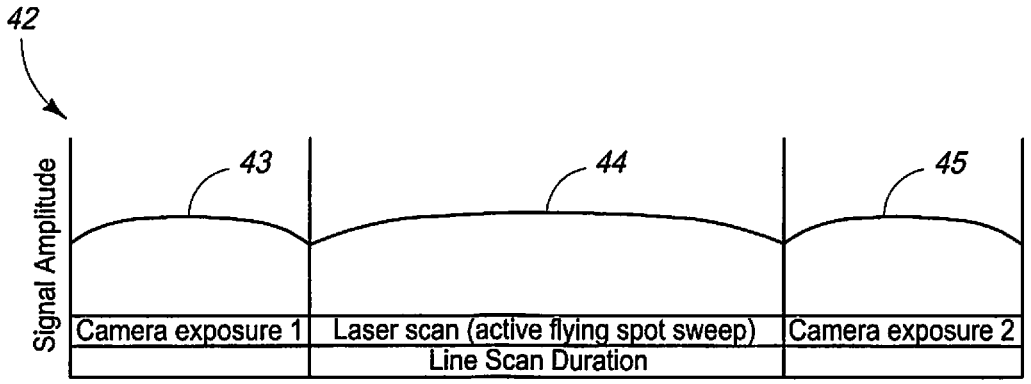
FIG. 1E1

(Partial timing overlap)

(Complete timing overlap)

METHOD AND APPARATUS FOR SORTING

RELATED APPLICATIONS

This utility patent application is a Continuation In Part (CIP) of co-pending U.S. application Ser. No. 14/997,173 titled Method and Apparatus for Sorting which was filed on Jan. 15, 2016 and for which a Notice of Allowance has been received; which is a divisional application of U.S. application Ser. No. 14/317,551, now U.S. Pat. No. 9,266,148 titled Method and Apparatus for Sorting which was filed on Jun. 27, 2014.

This utility patent application has joint inventors and at least one of the joint inventors herein are named joint inventors of U.S. application Ser. No. 14/997,173, and U.S. Pat. No. 9,266,148.

Pursuant to 35 USC§ 120 and 37 CFR§ 1.78, this CIP utility patent application has codependency with earlier filed U.S. patent application Ser. No. 14/997,173 for which this CIP utility patent application claims its priority benefit; and further this CIP utility patent application shares at least one joint inventor with earlier filed U.S. patent application Ser. No. 14/997,173 and earlier filed U.S. Pat. No. 9,266,148 from which this CIP utility patent application claims its priority benefit.

TECHNICAL FIELD

The present invention relates to a method and apparatus for sorting, and more specifically to a method and apparatus for sorting a stream of products, and wherein the method and apparatus generates multi-modal, multi-spectral images which contain a multiplicity of simultaneous channels of data which contain information on color, polarization, fluorescence, texture, translucence, transmittance and other information which represents and/or is an indicator for various external and internal aspects or characteristics of an item being inspected and which further can be used for identification, and feature and flaw detection and for sorting.

BACKGROUND OF THE INVENTION

The present invention relates to a method and apparatus for sorting, and more specifically to a method for detecting and identifying a characteristic which may be, but is not limited to, a defect in an agricultural product or object, and then removing the product having the detected and identified characteristic or removing the defect itself, from a moving product stream.

It has long be known that camera images including, line scan cameras are commonly combined with laser scanners or LIDAR and/or time of flight imaging for three dimensional imaging, and surface and subsurface inspection, and which are used to perceive depth, and distance, and to further track moving objects, and the like. Such devices have been employed in sorting apparatuses of various designs in order to identify acceptable and unacceptable objects, or products having detected and identified characteristics, within a stream of products to be sorted, thus allowing the sorting apparatus to remove undesirable objects or products from the stream of products in order to produce a homogeneous product stream which is more useful for food processors, and the like. Heretofore, attempts which have been made to enhance the ability to inspect objects effectively, in real-time, have met with somewhat limited success. In the present application, the term "real-time" when used in this document, relates to information processing which occurs within the span of, and substantially at the same rate, as that which it is depicted. "Real-time" may include several microseconds to a few milliseconds.

One of the chief difficulties associated with such efforts has been that when particular radiators, emitters, illuminators, detectors, sensors, and the like have been previously employed, and then energized both individually and, in combination with each other, they have undesirable affects and limitations including, but not limited to, lack of isolation of the signals of different modes, but similar optical spectrum; unwanted changes in the response per optical angle of incidence, and field angle; a severe loss of sensitivity or effective dynamic range of the sensor being employed, (i.e. low signal-to-noise ratio, low signal amplitude) among many others. Thus, the use of multiple sensors or interrogating means for detecting, gathering and providing information regarding the objects being sorted, when actuated, simultaneously, often destructively interfere with each other and thus limit the ability to identify external and internal features or characteristics of an object which would be helpful in classifying the object being inspected into different grades or classifications, or as being either, on the one hand, an acceptable product or object, or on the other hand, an unacceptable product or object, which needs to be excluded/removed from the product stream.

The developers of optical sorting systems which are uniquely adapted for visually inspecting a mass-flow of a given food product have endeavored, through the years, to provide increasing levels of information which are useful in making well-informed sorting decisions to effect sorting operations in mass-flow food sorting devices. While the creation of, capturing and processing of product data, including but not limited to images employing prior art cameras and other optical devices, such as but not limited to laser scanners, have long been known, it has also been recognized that data about, and images of a product formed by visible spectrum electromagnetic radiation often will not provide enough information for an automated sorting machine to accurately identify all (and especially hidden, internal or below surface) defects, and which may subsequently be later identified or develop after further processing of the product. For example, one of the defects in agricultural products which have troubled food processors through the years has been the effective identification of "sugar end" defects in potato products, and more specifically potato products that are destined for processing into food items such as French Fries, potato chips and the like.

Another example of a defect in agricultural products that has troubled food processors through the years has been the detection and/or identification of internal defects, or defects occurring below an external surface in agricultural products, including but not limited to detection of precursors of cancer-causing acrylamide (which is generated in high temperature cooking such as frying) and detection of other internal/below surface characteristics that are indicative of unacceptable items. Such characteristics may include, but are not limited to, the presence of chlorophyll which may be a predictor of the presence of solanine; and the detection of reducing sugars such as, but not limited to fructose and glucose that can react with asparagine to form acrylamide.

Chlorophyll, which is well known as causing the "green color" of plants frequently develops below the peel in potatoes that are exposed to light after harvesting. In small amounts, chlorophyll is not visually perceptible as "green" but the chlorophyll is nevertheless present and can cause the potato/piece of potato to be an unacceptable product. Further still, the presence of chlorophyll has been found to be a predictor of the presence of solanine and chaconine which are glyalkaloid poisons which have pesticide properties and which can cause illness if consumed. It is therefore important to identify potatoes and potato pieces having chlorophyll and to remove such potatoes and potato pieces from the product stream.

One of the primary methods to detect the presence of chlorophyll, which may be internal/below the surface, is through the detection and identification of chlorophyll fluorescence. Chlorophyll fluorescence occurs when chlorophyll is exposed to electromagnetic radiation which energizes the chlorophyll molecules which then emit light in the red and infra-red (IR) color spectrum. The irradiation of plant based products with electromagnetic radiation, including but not limited to ultraviolet radiation, infrared radiation, and electromagnetic excitation, and the detection and identification of emitted electromagnetic radiation and/or fluorescent light provides a method for making a sorting decision based on non-visually perceptible characteristics of the items being sorted. Similarly, the identification of other hidden and/or internal and/or below surface characteristics that are precursors to harmful and/or unacceptable characteristics may similarly be identified or determined by exposing the product stream to electromagnetic radiation of various wavelengths and substantially simultaneously monitoring and detecting emitted or reflected or refracted electromagnetic radiation which is indicative of the particular precursor and/or characteristic.

For example, potato strips or French Fries made from "sugar end" potatoes exhibit or display undesirable dark-brown areas on the product after the potato piece has been subjected to frying. This defect is typically caused by the higher concentration of reducing sugars found in the given darkened region of the potato. The process of frying the product results in caramelizing, which creates the undesirable dark brown region on the fried product. The challenge for food processors has been that the "sugar end" defects are typically invisible to traditional optical detection technology until after the potato product has been cooked. In view of this situation, potato strip and potato chip processors can be unaware they have "sugar end" problems within a given lot of potatoes until downstream food service customers fry the potato strips and chips and then provide complaints.

Those skilled in the art have recognized that a variety of factors can encourage development of such undesirable characteristics. It has further been found that reducing sugars can develop in tubers during cold storage prior to processing and that such reducing sugars may be converted back into sucrose (not a reducing sugar) by environmental conditions such as, but not limited to, warming the tubers to "room temperature" prior to cooking. As such, some of these undesirable characteristics can be difficult to detect and identify.

While the various prior art devices and methodology which have been used, heretofore, have worked with various degree of success, assorted industries such as food processors, and the like, have searched for enhanced means for discriminating between products or objects traveling in a stream so as to produce ever better quality products, or resulting products having different grades, for subsequent supply to various market segments.

A method and apparatus for sorting which avoids the detriments associated with the various prior art teachings, and practices utilized, heretofore, is the subject matter of the present application.

SUMMARY OF THE INVENTION

A first aspect of the present invention relates to a method and apparatus for sorting which includes providing a source of a product to be sorted, and which includes of a plurality of individual items each having a multitude of internal and external characteristics, and wherein the multitude of internal and external characteristics are selected from a group including color; light polarization; light fluorescence; light reflectance; light refraction; light scatter; light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items; conveying the plurality of individual items along a path of travel, and through an inspection station, and selectively irradiating and contemporaneously collecting electromagnetic radiation which is reflected, refracted, fluoresced, emitted, absorbed, scattered and/or transmitted from or by each of the plurality of individual items; providing a plurality of selectively energizable illumination sources and orienting the illumination sources along a single focal plane within the inspection station, and selectively energizing the illumination sources so as to illuminate and irradiate the individual items passing through the inspection station; providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation generates an interrogation signal, and wherein the plurality of selectively energizable illumination devices, when energized simultaneously, emit electromagnetic radiation which causes a known interference in the operation of at least one of the plurality of selectively actuated electromagnetic radiation detection devices, and enhances a contrast as the individual items pass through the inspection station; providing a controller for selectively energizing the plurality of selectively energizable illumination sources in a predetermined order, and for predetermined durations of time, and in predetermined wavelength spectrums, and in real time, so that the selectively actuated electromagnetic radiation detection devices receive the electromagnetic radiation and responsively generate the interrogation signals; acquiring, and communicating, the interrogation signals from the plurality of selectively actuated electromagnetic radiation detection devices to the controller; analyzing, with the controller, the acquired interrogation signals and identifying the interference within the respective interrogation signals; optimizing, with the controller, the interference, to increase the contrast between the multitude of internal and external characteristics of the individual items; detecting and identifying the multitude of internal and external characteristics of the individual items passing through the inspection station by forming a real-time, multiple-aspect representation of the individual items with the controller by utilizing the increased contrast provided by the optimized interference; and sorting the individual items passing through the inspection station based, at least in part, upon the multiple aspect representation formed by the controller, as the individual items pass through the inspection station.

Still another aspect of the present invention relates to a method and apparatus for sorting which includes aligning the respective first and second selectively energizable electromagnetic radiation emitters, and associated selectively actuated electromagnetic radiation capturing devices with each other to focus on a single focal plane, and locating the third and fourth selectively energizable electromagnetic radiation emitters, and associated selectively actuated electromagnetic radiation capturing devices, on the opposite side of the unsupported product stream and orienting the third and fourth selectively energizable electromagnetic radiation emitters and associated selectively actuated electromagnetic radiation capturing devices to focus on the single focal plane.

Still another aspect of the present invention relates to a method and apparatus for sorting which includes aligning the respective selectively energizable second and fourth electromagnetic radiation emitters and associated selectively actuated electromagnetic radiation capturing devices with each other to focus on a single focal plane, and selectively energizing the respective second and fourth electromagnetic radiation emitters, and selectively actuating the associated electromagnetic radiation capturing devices, in a phase delayed operation on opposite sides of the product stream such that each selectively energizable electromagnetic radiation emitter creates an intentional interference with another selectively actuated electromagnetic radiation capturing device.

Still another aspect of the present invention relates to a method and apparatus for sorting wherein the step of selectively energizing the respective electromagnetic radiation emitters in a predetermined pattern, and selectively actuating the electromagnetic radiation capturing devices in the predetermined pattern takes place in a time interval of about 50 microseconds to about 500 microseconds.

Still another aspect of the present invention relates to a method and apparatus for sorting wherein the first and third selectively energizable electromagnetic radiation emitters comprise pulsed light emitting diodes; and the second and fourth selectively energizable electromagnetic radiation emitters comprise laser scanners.

Still another aspect of the present invention relates to a method and apparatus for sorting wherein the respective selectively energizable electromagnetic radiation emitters, when energized, emit electromagnetic radiation which lies in a range of about 400 nanometers to about 1600 nanometers wavelength.

Still another aspect of the present invention relates to a method and apparatus for sorting wherein the step of conveying the product along a path of travel comprises providing a continuous belt conveyor having an upper and lower flight; and wherein the upper flight has a first intake end, and a second exhaust end; and positioning the first, intake end elevationally, above, the second, exhaust end.

Still another aspect of the present invention relates to a method and apparatus for sorting which includes conveying the product with the conveyor at a predetermined speed of about 3 meters per second to about 5 meters per second.

Still another aspect of the present invention relates to a method and apparatus for sorting wherein the product stream moves along a predetermined trajectory which is influenced, at least in part, by gravity which acts upon the unsupported product stream.

Still another aspect of the present invention relates to a method and apparatus for sorting which includes locating the product ejector about 50 millimeters to about 150 millimeters downstream of the inspection station.

Still another aspect of the present invention relates to a method and apparatus for sorting wherein the multitude of external and internal characteristics of the plurality of individual items are humanly perceptible.

Still another aspect of the present invention relates to a method and apparatus for sorting wherein the multitude of external and internal characteristics of the plurality of individual items are machine perceptible.

Still another aspect of the present invention relates to a method and apparatus for sorting wherein the multitude of external and internal characteristics of the plurality of individual items are not humanly perceptible.

Still another aspect of the present invention provides a method of sorting comprising providing a source of a product to be sorted, which includes of a plurality of individual items each having a multitude of internal and external characteristics, and wherein the multitude of internal and external characteristics are selected from a group including color; light polarization; light fluorescence; light reflectance; light scatter; light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items; conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items; providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station; providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation generates an interrogation signal, and wherein the plurality of selectively energizable illumination devices, if energized simultaneously, emit electromagnetic radiation which interferes in the operation of at least one of the plurality of selectively actuated electromagnetic radiation detection devices, and enhances a contrast, as the individual items pass through the inspection station.

Still another aspect of the present invention provides a controller for selectively energizing the plurality of illumination sources in a predetermined order, and for predetermined durations of time, and in predetermined wavelength spectrums, and in real time, so that the selectively actuated electromagnetic radiation detection devices receive the selective electromagnetic radiation and responsively generate the interrogation signals.

Still another aspect of the present invention provides the step of acquiring, and communicating, the interrogation signals from the plurality of selectively actuated electromagnetic radiation detection devices to the controller.

Still another aspect of the present invention provides the step of analyzing, with the controller, the acquired interrogation signals and identifying the interferences within the respective interrogation signals.

Still another aspect of the present invention provides the step of optimizing, with the controller, the interference, to increase the contrast between the multitude of characteristics of the individual items.

Still another aspect of the present invention provides the step of detecting and identifying the multitude of characteristics of the individual items passing through the inspection station by forming a real-time, multiple-aspect representation of the individual items with the controller by utilizing the increased contrast provided by the optimized interferences.

Still another aspect of the present invention provides the step of sorting the individual objects passing through the inspection station based, at least in part, upon the multiple aspect representation formed by the controller, as the individual objects pass through the inspection station.

Still another aspect of the present invention provides the step of providing a background in the inspection station and aligning the background along the single focal plane and wherein the background, when selectively energized by the controller, emits electromagnetic radiation for predetermined durations of time and in predetermined wavelength spectrums, so that the selectively actuated electromagnetic radiation detection devices receive the electromagnetic radiation from the selectively energized background, and the electromagnetic radiation from the selectively energized background corresponds to the interference.

Still another aspect of the present invention provides the step of selectively energizing the background for the predetermined durations of time partially temporally overlaps the selective energizing of at least one illumination source and the selective actuation of at least one electromagnetic radiation detection device.

Still another aspect of the present invention provides the step of selectively energizing the background for the predetermined durations of time completely temporally overlaps the selective energizing of at least one illumination source and the selective actuation of at least one electromagnetic radiation detection device.

Still another aspect of the present invention provides the step of selectively energizing the background for the predetermined durations of time does not temporally overlap the selective energizing of at least one illumination source and the selective actuation of at least one electromagnetic radiation detection device.

Still another aspect of the present invention provides the step of selectively energizing multiple foreground illumination sources for the predetermined durations of time partially temporally overlaps the selective energizing of at least one illumination source and the selective actuation of at least one electromagnetic radiation detection device.

Still another aspect of the present invention provides the step of selectively energizing multiple foreground illumination sources for the predetermined durations of time completely temporally overlaps the selective energizing of at least one illumination source and the selective actuation of at least one electromagnetic radiation detection device.

Still another aspect of the present invention provides the step of selectively energizing multiple foreground illumination sources for the predetermined durations of time does not temporally overlap the selective energizing of at least one illumination source and the selective actuation of at least one electromagnetic radiation detection device.

Still another aspect of the present invention provides the step of selectively energizing multiple foreground illumination sources for the predetermined durations of time which partially temporally overlap the selective energizing of the background.

Still another aspect of the present invention provides the step of selectively energizing multiple foreground illumination sources for the predetermined durations of time which completely temporally overlap the selective energizing of the background.

Still another aspect of the present invention provides the step of selectively energizing multiple foreground illumination sources for the predetermined durations of time which do not temporally overlap the selective energizing of the background.

Still another aspect of the present invention provides the step of determining a compensation that optimizes the interference and applying the determined compensation to the interference, by means of the controller, to address the interference; and making a sorting decision based upon the interrogation signal less the known interference.

Still another aspect of the present invention provides the step wherein the predetermined duration of time of energizing at least one selectively energizable illumination source temporally exceeds the predetermined duration of time of actuation of a corresponding selectively actuated electromagnetic radiation detection device so that the illumination provided by the energized illumination source is detected and received by plural electromagnetic radiation detection devices.

Still another aspect of the present invention provides the step wherein the interference allows an increase in interrogation signal amplitude.

Still another aspect of the present invention provides the step wherein the emitted electromagnetic radiation is synchronous.

Still another aspect of the present invention provides the step wherein the emitted electromagnetic radiation is phase-aligned.

Still another aspect of the present invention provides the step wherein the emitted electromagnetic radiation is collimated.

Still another aspect of the present invention provides the step wherein the emitted electromagnetic radiation is polarized.

Still another aspect of the present invention provides the step wherein the emitted electromagnetic radiation is diffused.

Still another aspect of the present invention provides the step wherein the emitted electromagnetic radiation is multidirectional.

Still another aspect of the present invention provides the step wherein the electromagnetic radiation is transmitted through the objects of interest and the selectively actuated electromagnetic radiation detectors receive the transmitted electromagnetic radiation; and the interrogation signal generated by the selectively actuated electromagnetic radiation detector is formed from received transmitted electromagnetic radiation.

Still another aspect of the present invention provides the step wherein contrast within the interrogation signal generated by the electromagnetic radiation detectors is improved by detecting a polarization response.

Still another aspect of the present invention provides the step wherein the electromagnetic radiation is reflected by the objects of interest and the electromagnetic radiation detectors receive the reflected electromagnetic radiation; and the interrogation signals generated by the electromagnetic radiation detectors is formed from received reflected electromagnetic radiation.

Still another aspect of the present invention provides the step wherein contrast within the interrogation signal generated by the electromagnetic radiation detectors is improved by detecting a polarization response.

Still another aspect of the present invention provides the step of initiating a predetermined synchronous phase aligned interference between selectively energized illumination sources and the selectively actuated electromagnetic radiation detection devices.

Still another aspect of the present invention provides the step optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

Still another aspect of the present invention provides a method for sorting comprising providing a source of a product to be sorted, which includes of a plurality of individual items each having a multitude of internal and external characteristics, and wherein the multitude of internal and external characteristics are selected from a group including color; light polarization; light fluorescence; light reflectance; light scatter light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items; conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items; providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station; providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation, generates an interrogation signal, and wherein the plurality of selectively energizable illumination devices, if energized simultaneously, emit electromagnetic radiation which interferes in the operation of at least one of the plurality of selectively actuated electromagnetic radiation detection devices, and enhances a contrast as the individual items pass through the inspection station; providing a controller for selectively energizing the plurality of selectively energizable illumination sources in a predetermined order, and for predetermined durations of time, and in predetermined wavelength spectrums, and in real time, so that the selectively actuated electromagnetic radiation detection devices receive the electromagnetic radiation and responsively generate the interrogation signals; acquiring, and communicating, the interrogation signals from the plurality of selectively actuated electromagnetic radiation detection devices to the controller; analyzing, with the controller, the acquired interrogation signals and identifying the interference within the respective interrogation signals; optimizing, with the controller, the interference, to increase the contrast between the multitude of internal and external characteristics of the individual items; detecting and identifying the multitude of internal and external characteristics of the individual items passing through the inspection station by forming a real-time, multiple-aspect representation of the individual items with the controller by utilizing the increased contrast provided by the optimized interference; and sorting the individual items passing through the inspection station based, at least in part, upon the multiple aspect representation formed by the controller, as the individual items pass through the inspection station.

Still another aspect of the present invention provides the step wherein|[JT1] the contrast within the interrogation signal generated by the selectively actuated electromagnetic radiation detection device is improved by detecting a polarization response.

Still another aspect of the present invention provides the step providing a background in the inspection station and aligning the background along the single focal plane and wherein the background, when selectively energized by the controller, emits electromagnetic radiation for predetermined durations of time and in predetermined wavelength spectrums, so that the selectively actuated electromagnetic radiation detection devices receive the electromagnetic radiation from the selectively energized background, and the electromagnetic radiation from the selectively energized background corresponds to the interference.

Still another aspect of the present invention provides multiple foreground illumination sources, and wherein the selective energizing of the multiple foreground illumination sources for the predetermined durations of time partially temporally overlaps the selective energizing of at least one illumination source and the selective actuation of at least one electromagnetic radiation detection device.

Still another aspect of the present invention provides multiple foreground illumination sources, and wherein the selective energizing of the multiple foreground illumination sources for the predetermined durations of time completely temporally overlaps the selective energizing of at least one illumination source and the selective actuation of at least one electromagnetic radiation detection device.

Still another aspect of the present invention provides the step determining a compensation that optimizes the interference and applying the determined compensation to the interference, by means of the controller, to address the interference; and making a sorting decision based upon the interrogation signal less the known interference.

Still another aspect of the present invention provides the step wherein the interference allows an increase in interrogation signal amplitude.

Still another aspect of the present invention provides the step wherein the emitted electromagnetic radiation is synchronous.

Still another aspect of the present invention provides the step wherein the emitted electromagnetic radiation is phase-aligned.

Still another aspect of the present invention provides the step wherein the emitted electromagnetic radiation is collimated.

Still another aspect of the present invention provides the step wherein the emitted electromagnetic radiation is polarized.

Still another aspect of the present invention provides the step wherein the emitted electromagnetic radiation is diffused.

Still another aspect of the present invention provides the step wherein the emitted electromagnetic radiation is multi-directional.

Still another aspect of the present invention provides the step wherein the electromagnetic radiation is transmitted through the objects of interest and the selectively actuated electromagnetic radiation detectors receive the transmitted electromagnetic radiation; and the interrogation signal generated by the selectively actuated electromagnetic radiation detector is formed from received transmitted electromagnetic radiation.

Still another aspect of the present invention provides the step wherein|[JT2]|[JT3] contrast within the interrogation signal generated by the electromagnetic radiation detectors is improved by detecting a polarization response.

Still another aspect of the present invention provides the step wherein the electromagnetic radiation is reflected by the objects of interest and the electromagnetic radiation detectors receive the reflected electromagnetic radiation; and the interrogation signals generated by the electromagnetic radiation detectors is formed from received reflected electromagnetic radiation.

Still another aspect of the present invention provides the step wherein contrast within the interrogation signal generated by the electromagnetic radiation detectors is improved by detecting a polarization response.

Still another aspect of the present invention provides the step initiating a predetermined synchronous phase aligned interference between selectively energized illumination sources and the selectively actuated electromagnetic radiation detection devices.

Still another aspect of the present invention provides the step optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

Still another aspect of the present invention provides a sorting apparatus comprising a source of individual products to be sorted; a conveyor for moving the individual products along a given path of travel, and into an inspection station; a plurality of selectively energizable illuminators located in different, spaced, angular orientations relative to the inspection station, and which, when energized, individually emit electromagnetic radiation which is directed towards, and reflected from or transmitted by, the respective products passing through the inspection station; a plurality of selectively operable image capturing devices which are located in different, spaced, angular orientations relative to the inspection station, and which, when rendered operable, captures the electromagnetic radiation reflected from or transmitted by the individual products passing through the inspection station, and forms an image of the electromagnetic radiation which is captured, and wherein the respective image capturing devices each form an image signal; a controller coupled in controlling relation relative to each of the plurality of illuminators and image capturing devices, and wherein the image signal of each of the image capturing device is delivered to the controller, and wherein the controller selectively energizes individual illuminators, and image capturing devices in a predetermined sequence so as generate multiple image signals which are received by the controller, and which are combined into a multiple aspect image, in real-time, and which has a multiple of characteristics and gradients of the measured characteristics, and wherein the multiple aspect image which is formed allows the controller to identify individual products in the inspection station having a predetermined feature; and a product ejector coupled to the controller and which, when actuated by the controller, removes individual products from the inspection station having features identified by the controller from the multiple aspect image.

Still another aspect of the present invention provides a sorting apparatus further comprising a plurality of selectively energizable illuminators, which when energized, emit visible, and invisible bands of electromagnetic radiation.

Still another aspect of the present invention provides a sorting apparatus wherein the selectively energizable illuminators are located on opposite sides of the path of travel of the individual products as they individually move through the inspection station, and wherein the respective, selectively energizable illuminators each have a primary axis of illumination which intersects along a line of reference which is located in the inspection station, and through which the individual products pass.

Still another aspect of the present invention provides a sorting apparatus wherein the controller selectively energizes individual illuminators and image capturing devices in a predetermined sequence that at least partially overlap one another to generate an intentional interference.

Still another aspect of the present invention provides a sorting apparatus wherein the controller selectively energizes individual illuminators and image capturing devices in a predetermined sequence that completely overlap one another to generate an intentional interference.

Still another aspect of the present invention provides a sorting apparatus wherein the resulting multiple aspect images formed by the controller include feature contrasts which include gradients comprised of differences in image signal amplitudes within an aspect and differences between amplitudes of different aspects to enhance the discrimination or identification of features of interest within the multiple aspect images.

Still another aspect of the present invention provides a sorting apparatus wherein the resulting multiple aspect images formed by the controller include feature contrasts which include gradients comprised of differences in image signal amplitudes within an aspect and differences between amplitudes of different aspects to enhance the discrimination or identification of features of interest within the multiple aspect images.

These and other aspects of the present invention will be discussed in greater detail hereinafter.

BRIEF DESCRIPTION OF THE DRAWINGS

Preferred embodiments of the invention are described below with reference to the following accompanying drawings.

FIG. 1E is a greatly simplified, schematic view of a first form of the present invention.

FIG. 1E1 is a greatly simplified, graphical depiction of the operation of the first form of the present invention.

DETAILED DESCRIPTION OF THE PREFERRED EMBODIMENTS

Figure 1A:
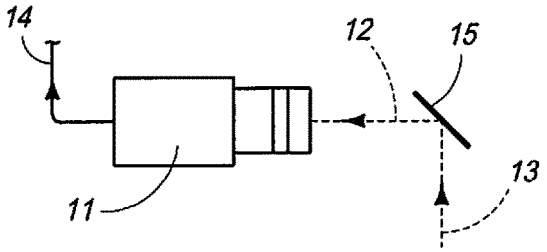
FIG. 1A is a greatly simplified, side elevation view of an electromagnetic radiation detection device, (shown as a camera) located in spaced relation relative to a mirror.

This disclosure of the invention is submitted in furtherance of the constitutional purposes of the U.S. Patent Laws "to promote the progress of science and useful arts." (Article I, Section 8).

As noted earlier in the specification, the known benefits and relative strengths of camera imaging and laser scanning, and how these specific forms of product interrogation can be complimentary when used for product sorting applications are well known. It is now practical to combine high speed image data acquisition with sufficiently powerful computational and/or image processing capability to fuse and sort multiple data streams in real-time, that is, with response times of several microseconds, to a few milliseconds, to generate useful images of objects traveling in a product stream. However, as noted, numerous problems exist when illuminators, emitters, detectors and/or interrogators of various designs are used in different modes of operation. It is well known that these modes of operation are often not normally or naturally compatible with each other without some loss of information or destructive signal interference. Furthermore, in optical applications, traditionally used means for spatially or spectrally separating signals in order to enhance signal strength and contrast often are not sufficient. Consequently, the present application discloses a new way of controlling and acquiring multi-modal and multi-dimensional image features of objects requiring inspection. As noted above, it is well known that destructive interference often occurs between cameras and laser scanners which are operated simultaneously and in close proximity, or relative one to the other.

In addition to the problems noted earlier in this Application with regard to conventional detection and interrogation means used to inspect a stream of products, it is known that dynamic, spatial variances for products traveling as high speed bulk particulate, cannot be corrected or compensated, in real-time, by any conventional means. Consequently, traditional approaches to combine camera, and laser scanning through the separation, in time, or space, cannot support the generation of real-time pixel level, multi-modal image data utilization or fusion.

Those skilled in the art will recognize that spectral isolation is not practical for high order, flexible and/or affordable multi-dimensional detector or interrogator channel fusion. This is due, in large measure, to dichroic costs, and the associated sensitivity of angle of incidence and field angles relative to spectral proximity of desirable camera and laser scanner channels. Additional problems present themselves in managing "stacked tolerances" consisting of tightly coupled multi-spectral optical and optoelectronic components.

Those skilled in the art will recognize that the relationship between reflected, refracted, transmitted and absorbed electromagnetic energy, and these respective interactions with individual products moving in a product stream, provides assorted opportunities for non-destructive interrogation of individual objects moving in the stream, so as to determine the identity and quality of the product being inspected or sorted. Those skilled in the art will also recognize that there are known limits to acquiring reflected, refracted and transmitted electromagnetic radiation simultaneously. In particular, it's known that the product of reflection and transmission does not allow, under current conditions, measuring reflection and transmission of the electromagnetic radiation, independently. However, the present invention provides a solution to this dilemma, whereby, measured reflectance and measured transmission of electromagnetic radiation may be made substantially, simultaneously, and in real-time, so as to provide an increased level of data available and upon which sorting decisions can be made.

In the present invention, the method and apparatus, as described, provides an effective means for forming, and sorting and fusing data channels from multiple detectors and interrogators using three approaches. These approaches include: first, a spectral approach; second a spatial approach; and third a temporal [time] approach. With regard to the first approach, that being the spectral approach, the present method and apparatus, is operable to allocate wavelengths of electromagnetic radiation [whether visible or invisible] by an appropriate selection of a source of electromagnetic radiation, and the use of optical filters. Further in this spectral approach, the provision of laser scanner and camera illumination spectra is controlled. Still further, a controller is provided, as will be discussed, hereinafter, and which is further operable to adjust the relative color intensity of camera illumination which is employed. Still further the spectral approach which forms and/or fuses inspection channels from multiple detectors, also coordinates the detection spectra so as to optimize contrast features, and the number of possible detector channels which are available to provide data for subsequent combination.

With regard to the second spatial approach, this approach, in combination with the spectral and temporal approaches, includes a methodology having a step of providing coincident views from the multiple electromagnetic radiation detecting devices to support inspection/image data acquisition or fusion. Secondly, the spatial approach includes a step for the separation of the multiple electromagnetic radiation detectors, and related detection zones to control signal interference from electromagnetic radiation detectors having incompatible operational characteristics. Yet further, the spatial approach includes a step of adjusting the electromagnetic radiation emitter intensity, and shaping the electromagnetic radiation emissions to optimize field uniformity, and to further compensate for collection of electromagnetic radiation waves, which may be employed in the apparatus as described hereinafter.

With regard to the third temporal [time] approach to assist in the formation of a resulting fused inspection data/image channels, the temporal approach includes the coordination of multiple inspections in a synchronous or predetermined pattern, and the coordinated allocation and phasing of data acquisition periods so as to coordinate different inspection/imaging modes to coordinate and regulate temporal and spectral overlap, and signal interference, in a manner not possible heretofore. The temporal approach also includes a coordinated synchronized, phase adjusted, and sometimes pulsed (strobed) inspection/illumination, which is effective to isolate different inspection modes, and to control spectral overlap, and to control signal interference. The present invention is operable to form real-time, multi-dimensional inspection from detection sources, which include different modes of sensing, and contrast generation, such that the resulting inspections include feature-rich contrasts and are not limited to red, green or blue and similar color spaces. Further, the present invention is not limited primarily to represent three dimensional spatial dimensions. Rather, the present invention fuses or joins together inspection data and imaging data from multiple sources to generate high-order, multi-dimensional contrast features representative of the objects being inspected so as to better identify desired features, and constituents and the characteristics of the objects, and which can be utilized for more effective sorting of the stream of objects. The present invention as described, hereinafter, includes line scan or laser detectors, which correlate and fuse multiple channels of data having feature-rich object contrasts from streaming inspection data in real-time. This is in contrast to the more traditional approach of using two dimensional or area-array images, with or without lasers, as the basis for the formation of enhanced, three dimensional spatial or topographic inspection of individual objects moving within a stream of objects to be sorted.

Most importantly, the present invention, as described hereinafter, includes the third approach temporal [time] synchronization in combination with phase controlled, detector or interrogator isolation. This may be done in selective and variable combinations. While the present invention supports and allows for the use of more common devices such as optical beams splitters; spectra or dichroic filters; and polarization elements to isolate and combine the outputs of different detectors or interrogators, the present invention, more specifically, provides an effective means for separating and/or selectively and constructively combining inspection data from detection or interrogation sources that would otherwise destructively interfere with each other. As indicated earlier, while prior art methods are in existence, which employ beam splitters, dichroic spectral filters, and/or polarizing elements in various ways, these devices, and the associated methodology associated with their utilization, both individually, and in combination with each other, have many undesirable effects and limitations including, but not limited to, a lack of isolation of signals of different modes, but similar optical spectrum; unwanted change in a response per optical angle of incidence, and field angles; and/or a severe loss of sensitivity or affected dynamic range.

The apparatus and method of the present invention is generally indicated by the numeral 10 in FIG. 1A, and following. Referring now to FIG. 1A, the apparatus and method 10 of the present invention includes an electromagnetic radiation detection device 11, here shown as a camera 11 of traditional design. The camera 11 has an optical axis which is generally indicated by the numeral 12. The optical axis 12, receives reflected electromagnetic radiation 13. Upon receiving the reflected electromagnetic radiation 13, which may be visible or invisible, the camera 11 produces a device signal 14 also referred to herein as an interrogation signal 14, which is subsequently provided to an image pre-processor, which will be discussed in greater detail, below. In the arrangement as seen in FIG. 1A, a mirror 15 is provided, and which is utilized to direct or reflect electromagnetic radiation 13 along the optical axis 12 of the camera 11, so that the camera 11 can form an appropriate interrogation signal 14 representative of the electromagnetic radiation, which has been collected by the camera 11.

Figure 1B:
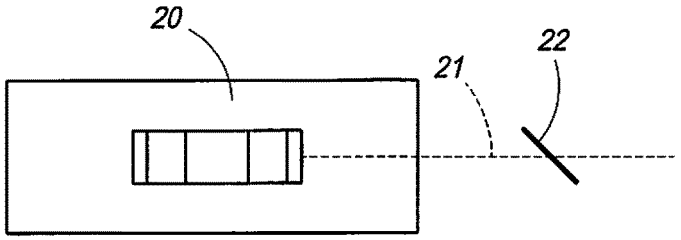
FIG. 1B is a greatly simplified, schematic view of an electromagnetic radiation emitter (shown as a laser scanner), and a dichroic beam mixing optical element.

Referring now to FIG. 1B, the present apparatus and method 10 includes, in some forms of the invention, another form of electromagnetic radiation detector 20, here shown as a laser or line scanner of traditional design, and which is generally indicated by the numeral 20. The laser scanner 20 has an optical axis which is indicated by the numeral 21. Still further, and in one possible form of the invention, a dichroic beam mixing optical element 22 of traditional design is provided, and which is operable to act upon the reflected electromagnetic radiation 13, as will be described hereinafter so as to provide reflected electromagnetic radiation 13, which is then directed along the optical axis 12 of the camera 11.

Figure 1C:
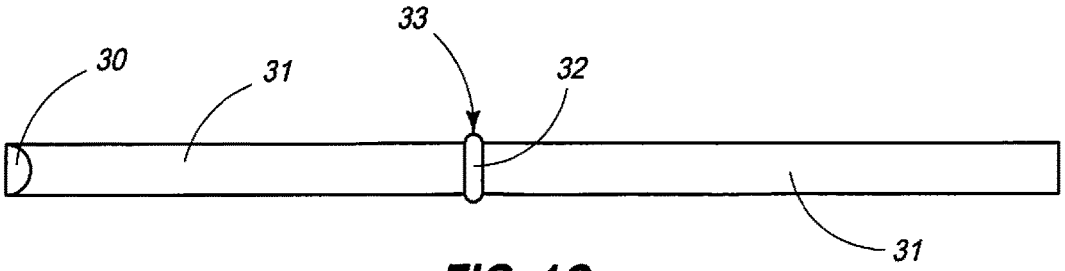
FIG. 1C is a greatly simplified, schematic representation of an electromagnetic radiation emitter emitting a beam of visible or invisible electromagnetic radiation, and wherein a detector focal plane is graphically depicted in spaced relation relative to the electromagnetic radiation emitter and along the emitted beam.
Figure 1D:
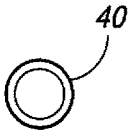
FIG. 1D is a greatly simplified depiction of a background element which as illustrated in the drawings, hereinafter, can be either passive, that is, no electromagnetic radiation is emitted by the background; or active, that is, the background can emit electromagnetic radiation, which is visible, or invisible.

Referring now to FIG. 1C, the present apparatus and method 10 includes a multiplicity of electromagnetic radiation emitters, here shown as illumination devices which are generally indicated by the numeral 30. The multiplicity of illumination devices 30 may be located at various positions and at various orientations so as to provide the desired illumination and irradiation of objects of interest 200 to. In this quite simplistic view, the respective illumination devices 30, when selectively energized during predetermined time intervals, each produce a beam of electromagnetic radiation 31 [which may be collimated or not collimated, or polarized or not polarized] and which is directed towards a location of a detector and/or interrogator focal plane, and which is generally indicated by the numeral 32. The location of the detector or interrogator focal plane 32 represents an orientation or location where a stream of objects to be inspected passes therethrough. The focal plane 32 is located within an inspection station 33, as will be discussed in further detail, below. In the drawings, as provided, it will be recognized that the present apparatus and method 10 includes a background, which is generally, and simply illustrated by the numeral 40 in FIG. 1D. The background 40 is located along the optical axis of the camera 11, and the optical axis 21 of the laser scanner 20. The background 40 can be passive, that is, the background 40 emits no electromagnetic radiation, which is visible or invisible, or, on the other hand, the background 40 may be active, that is, the background 40 may be selectively energized to emit electromagnetic radiation, which may be either visible or invisible, depending upon the sorting application being employed.

Referring now to FIG. 1E a first form of the invention 41 is illustrated. In its most simplistic form, the invention 10 includes electromagnetic radiation detection devices, shown as a camera 11, and a laser scanner 20, which are positioned on one side of an inspection station 33. Plural electromagnetic radiation emitters, shown as illumination devices 30, 40 are provided, and which are also located on one side of the inspection station 33. As illustrated, the background 40 is located on the opposite side of the inspection station 33. Electromagnetic radiation (light) which is generated by the illuminators 30, is directed toward the focal plane 32. Further, objects requiring inspection pass through the inspection station 33, and reflected electromagnetic radiation 13 from the objects 202 is received by the electromagnetic radiation detection devices 11, 20. Referring now to FIG. 1E1, a graphical depiction of the first form of operation of the invention 41 is illustrated. As will be appreciated, the methodology includes a step of selectively energizing the electromagnetic radiation detector camera 11 during two discrete time intervals, which are both before, and after, the electromagnetic radiation detector laser scanner 20 is rendered operable.

Figure 2:
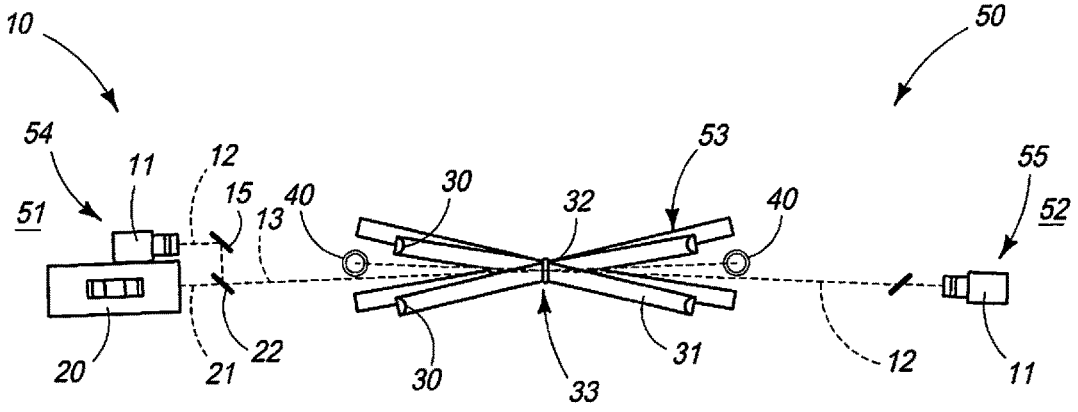
FIG. 2 is a greatly simplified, side elevation view of a second form of the present invention.
Figure 2A:
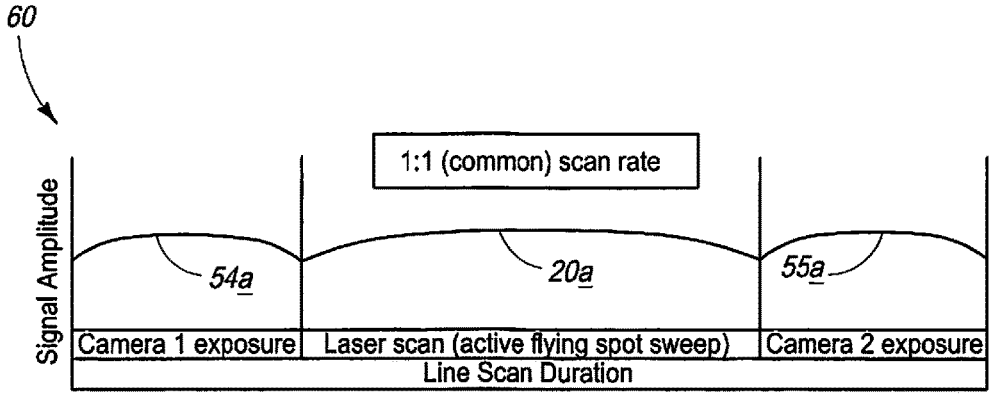
FIG. 2A is a greatly simplified, graphical depiction of the second form of the invention during operation.
Figure 2B:
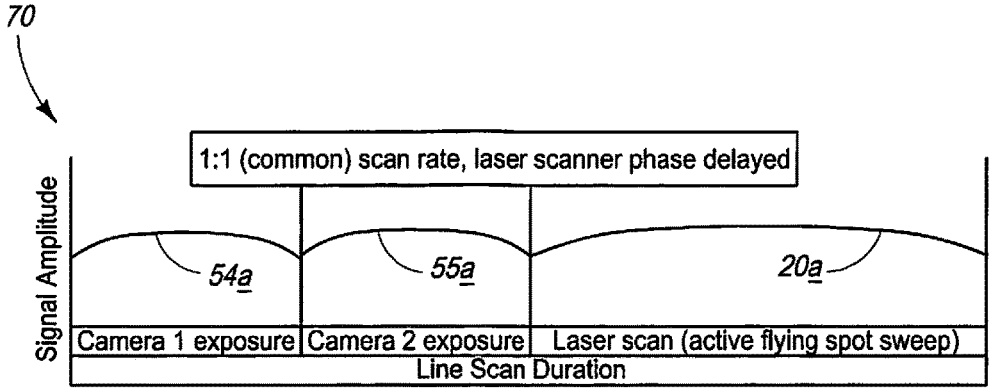
FIG. 2B is a greatly simplified, graphical depiction of a second mode of operation of the second form of the invention.

Referring now to FIG. 2, the second form of the invention 50 is shown, and which is operable to interrogate a stream of products, as will be discussed, below. It should be understood that the earlier-mentioned inspection station 33, through which a stream of products pass to be inspected, or interrogated, has opposite first and second sides 51 and 52, respectively, and which are spaced from the focal plane 32. In the second form of the invention 50, a multiplicity of electromagnetic radiation emitters 53 are positioned on the opposite first and second sides 51 and 52 of the inspection station 33, and are oriented so as to generate waves of electromagnetic radiation 31, and which are directed at the focal plane 32, and through which the stream of the products pass for inspection. In the arrangement as seen in FIG. 2, the second form of the invention 10 includes a first camera detector 54, and a second camera detector 55, which are located on the opposite first and second sides 51 and 52 of the inspection station 33. As can be seen by an inspection of the drawings, the optical axis 12 of the respective electromagnetic radiation detector cameras 11, which are used in this form of the invention, are directed to the focal plane 32, and through which the objects to be inspected pass, and further extends to the background 40. Referring now to FIG. 2A, a first mode of operation 60, of the invention arrangement, is illustrated. In this graphical depiction, the temporal actuation of the respective detector cameras 54 and 55, respectively, as depicted in FIG. 2, is shown. The respective camera 11 energizing or exposure time is plotted as against signal amplitude as compared with the electromagnetic radiation detection device laser scanner 20. As can be seen, the detector camera 11 actuation or exposure time is selected so as to achieve a one-to-one (1:1) common scan rate with the electromagnetic radiation detector laser scanner 20. As will be recognized, the summed exposure time for detector cameras 1 and 2 (54 and 55) is equal to the active time period during which the electromagnetic radiation detector laser scanner 20 is operational. As will be recognized, the signal amplitude of the first electromagnetic radiation detector camera is indicated by the numeral 54(*a*). The signal amplitude of the electromagnetic radiation detector laser scanner 20 is indicated by the numeral 20(*a*) and the signal amplitude of the second electromagnetic radiation detector camera 55 is indicated by the numeral 55(*a*). Referring again to FIG. 2, and as a second possible mode of operation for the form of the invention, as seen in FIG. 2, an alternative arrangement for the selective actuation or exposure of the electromagnetic radiation detector cameras 54 and 55 are provided relative to the duration and/or operation of the electromagnetic radiation detector laser scanner 20. Again, the duration of the respective exposures of the electromagnetic radiation detector cameras 54 and 55 is equal to the duration of the active electromagnetic radiation detector laser scanner 20 operation as provided. In the arrangement as seen in FIG. 2B, it will be recognized that in the second mode of operation 70, the laser scanner 20, is actuated in a phase-delayed mode; however, in the mode of operation 70 as graphically depicted, a 1:1, a common scan rate is achieved.

Figure 3:
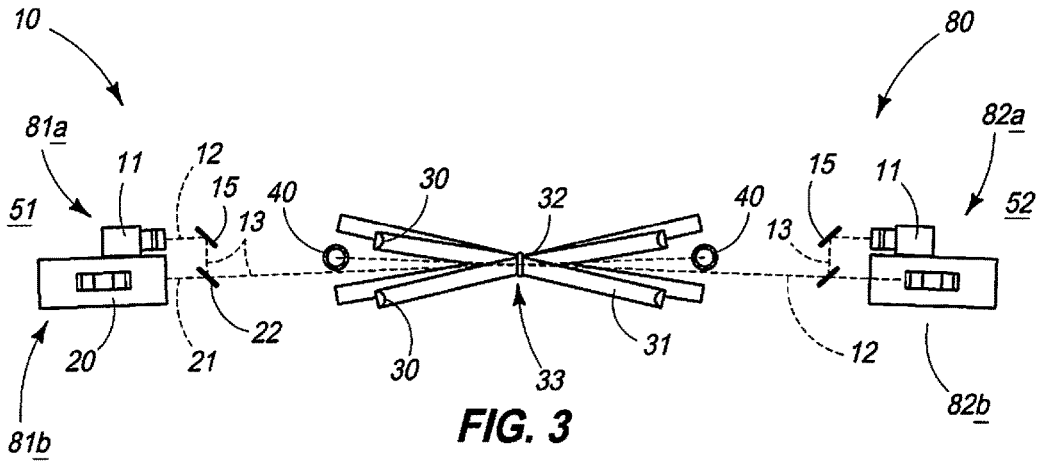
FIG. 3 is a greatly simplified, graphical depiction of a third form of the present invention.
Figure 3A:
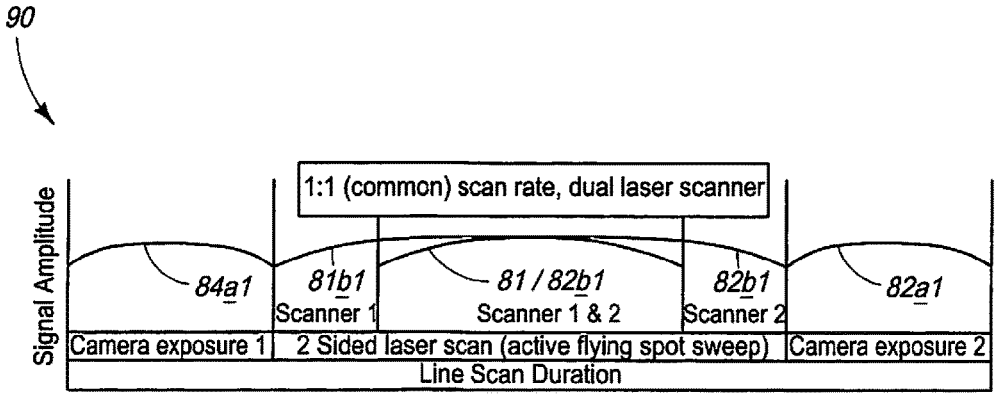
FIG. 3A is a greatly simplified, graphical depiction of the operation of the third form of the invention as depicted in FIG. 3.
Figure 3B:
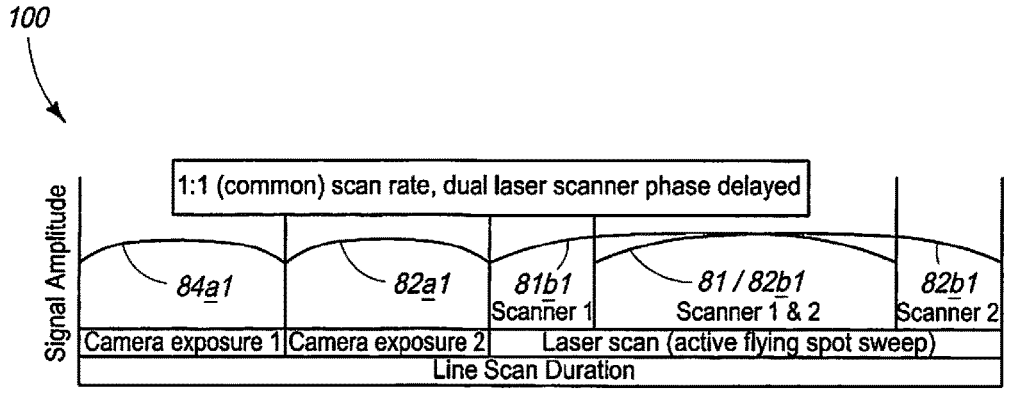
FIG. 3B is a greatly simplified, graphical depiction of the operation of the present invention as shown in FIG. 3 during a second mode of operation.

Turning now to FIG. 3, a third form of the invention 80 is illustrated in a quite simplistic form. The third form of the invention 80 includes a first electromagnetic radiation detector camera and electromagnetic radiation detector laser scanner combination indicated by the numerals 81*a* and 81*b* respectively, and which are positioned at the first side 51, of the inspection station 33. Still further, the third form of the invention includes a second electromagnetic radiation detector camera and electromagnetic radiation detector laser scanner combination 82*a* and 82*b*, respectively. Again, in the third form of the invention 80, multiple electromagnetic radiation emitter illumination devices 30, of varying wavelength bands, are provided, and which are selectively, electrically actuated so as to produce electromagnetic radiation 31, which is directed towards the focal plane 32 and inspection station 33. Referring now to FIG. 3A, a first mode of operation 90, for the third form of the invention 80, as seen in FIG. 3, is graphically depicted. It will be recognized that the combinations of the first and second electromagnetic radiation detector cameras 81*a* and 82*a*, along with electromagnetic radiation detector laser scanners 81*b* and 82*b* as provided, provide a 1:1 scan rate. Again, when studying FIG. 3A, it will be recognized that the selective actuation or exposure of the respective electromagnetic radiation detector cameras 81*a* and 82*a*, respectively, is equal to the time duration that the electromagnetic radiation detector laser scanners 81*b* and 82*b*, are operational. The signal amplitude of the first electromagnetic radiation detector camera is indicated by the numeral 81*a*1, and the signal duration of the electromagnetic radiation detector laser scanner 81*b* is indicated by the numeral 81*b*1. Still further, the signal amplitude of the second electromagnetic radiation detector camera 82*a* is indicated by the numeral 82*a*1, and the signal duration of the second electromagnetic radiation detector laser scanner is indicated by the numeral 82*b*1. Another alternative mode of operation is indicated by the numeral 100 in FIG. 3B. However in this arrangement, while a 1:1 common scan rate is achieved, the dual electromagnetic radiation detector laser scanners 81*b* and 82*b*, respectively, are phase delayed.

Figure 4:
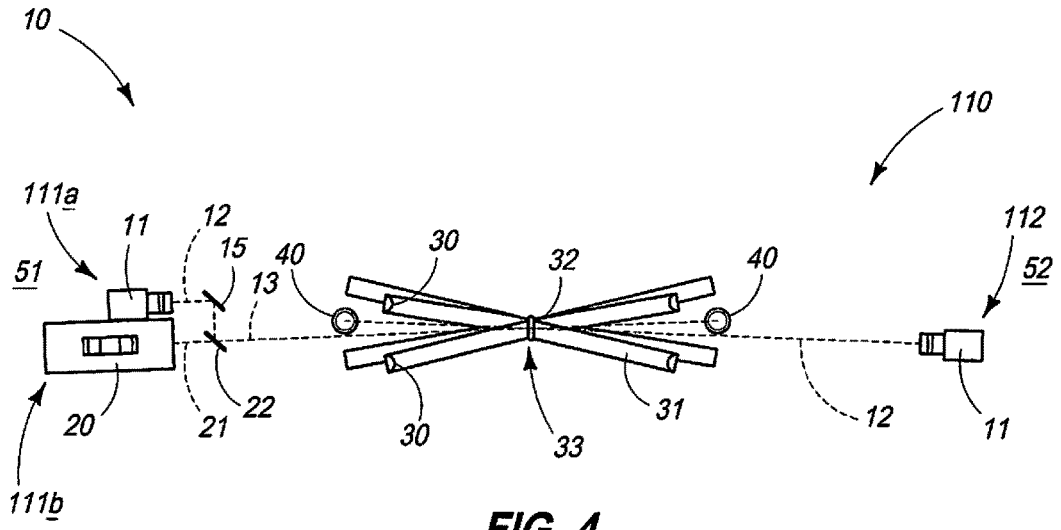
FIG. 4 is still another, greatly simplified, side elevation view of yet another form of the present invention.
Figure 4A:
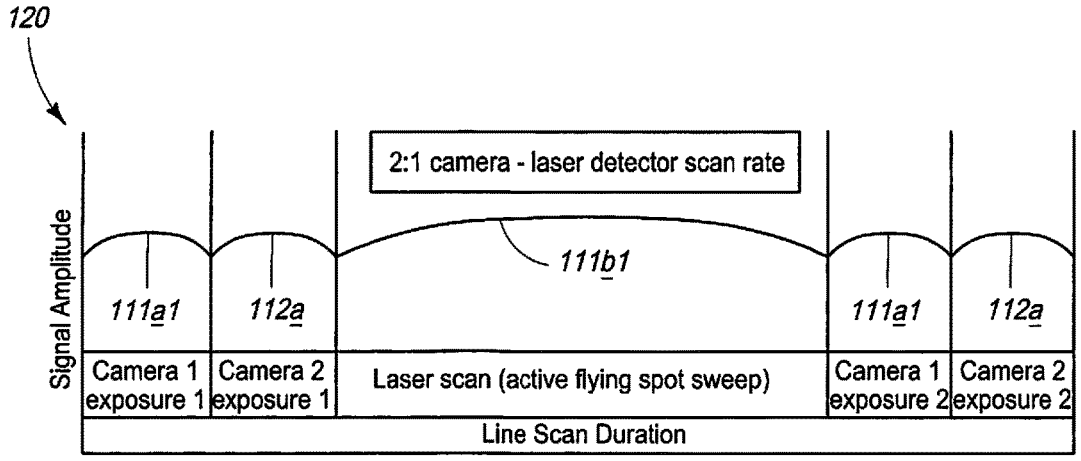
FIG. 4A is a greatly simplified, graphical depiction of the operation of the invention as seen in FIG. 4.

Referring now to FIG. 4, a fourth form of the invention is generally indicated by the numeral 110. In the arrangement, as seen in FIG. 4, a first electromagnetic radiation detector camera and electromagnetic radiation detector laser scanner combination are generally indicated by the numerals 111*a* and 111*b*, respectively, are provided, and which are positioned on one of the opposite sides 51, 52 of the inspection station 33. In this arrangement a second electromagnetic radiation detector camera 112 is positioned on the opposite side of the inspection station. In the mode of operation as best seen in the graphical depiction as illustrated in FIG. 4A, a 2:1 electromagnetic radiation detector camera-laser scanner detection scan rate is achieved. The signal amplitude of the first electromagnetic radiation detector camera 111*a* is indicated by the numeral 111*a*1, and the signal amplitude of the electromagnetic radiation detector laser scanner 111*b* is indicated by the numeral 111*b*1. Still further, the signal amplitude of the second electromagnetic radiation detector camera 112 is illustrated in FIG. 4A, and is indicated by the numeral 112*a*. Again, by a study of FIG. 4A, it will be recognized that the respective electromagnetic radiation detector cameras and electromagnetic radiation detector laser scanners, which are provided, can be selectively actuated during predetermined time periods to achieve the benefits of the present invention.

Figure 5:
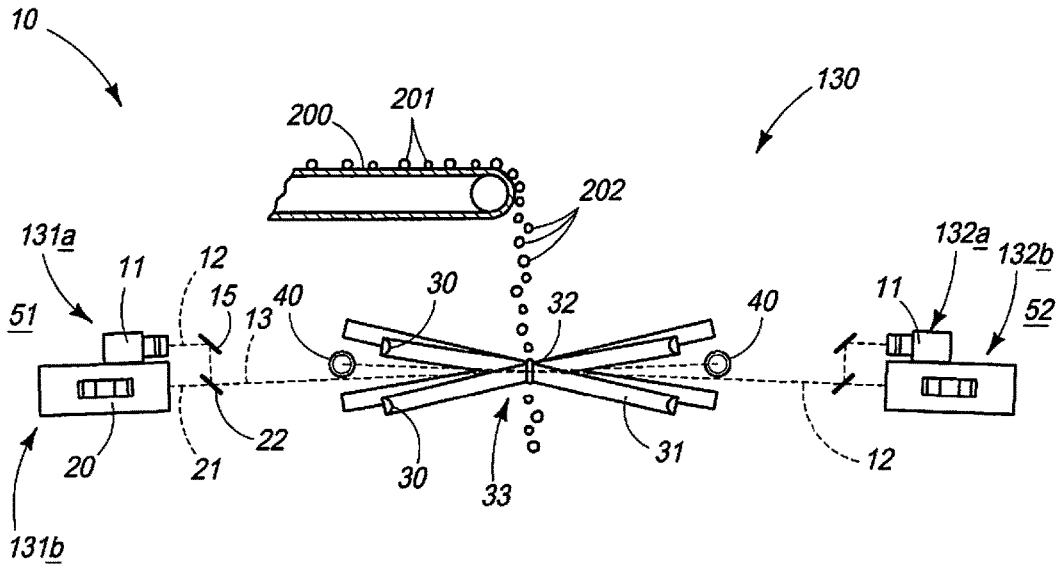
FIG. 5 is a greatly simplified, side elevation view of yet another form of the present invention.
Figure 5A:
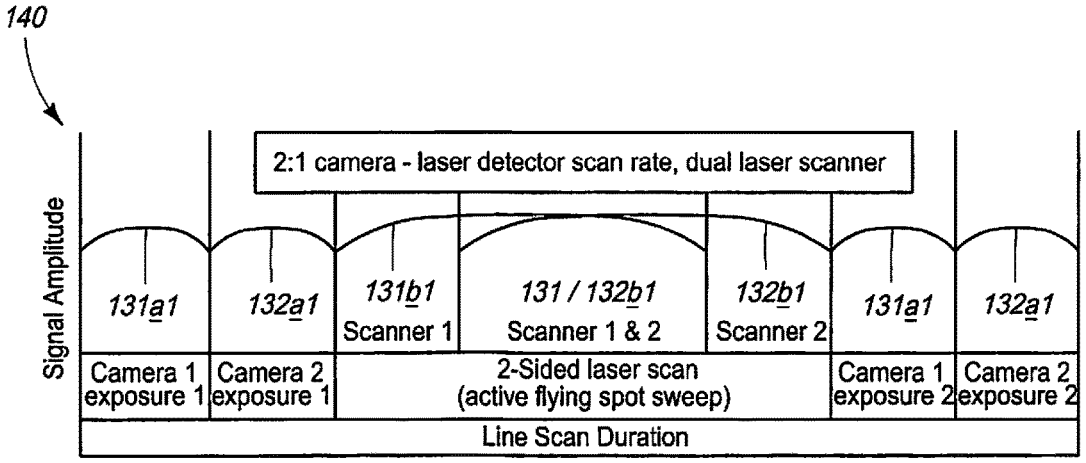
FIG. 5A is a greatly simplified, graphical depiction of the operation of the form of the invention as seen in FIG. 5.

Referring now to FIG. 5, a fifth form of the invention is generally indicated by the numeral 130. In this arrangement, which implements the methodology of the present invention, a first electromagnetic radiation detector camera and electromagnetic radiation detector laser scanner combination, are indicated by the numerals 131*a* and 131*b*, respectively, are provided. The first electromagnetic radiation detector camera and electromagnetic radiation detector line or laser scanner combination 131*a* and 131*b* are located on one side 51, 52 of the inspection station 33. Still further in this form of the invention 130, a second electromagnetic radiation detector camera and electromagnetic radiation detector laser scanner combination is indicated by the numerals 132*a* and 132*b*, respectively. The second electromagnetic radiation detector camera and electromagnetic radiation detector laser scanner combination is located on the opposite side 51, 52 of the inspection station 33. During one possible mode of operation of the invention, which is seen in FIG. 5A, and which is indicated by the numeral 140, the signal amplitude of the respective first and second electromagnetic radiation detector camera and electromagnetic radiation detector laser scanner combination 131*a*, 131*b*, as described above, is shown. In the mode of operation 140 as depicted, a 2:1 (two-to-one) electromagnetic radiation detector camera-laser detection scan rate is achieved, utilizing this dual electromagnetic radiation detector camera, dual laser scanner arrangement. Again by studying FIG. 5A, it can be seen that the individual electromagnetic radiation detector cameras 131*a*, 132*a* and electromagnetic radiation detector laser scanners 131*b*, 132*b*, as provided, can be selectively, electrically energized/actuated so as to provide a data stream that provides the benefits of the instant invention.

Figure 6:
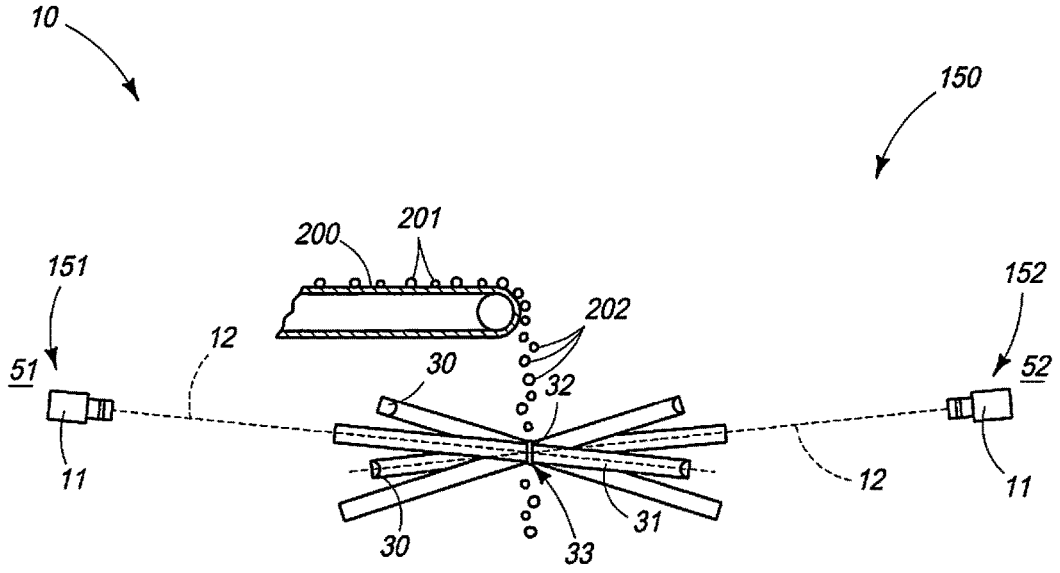
FIG. 6 is a greatly simplified, side elevation view of yet another form of the present invention.
Figure 6A:
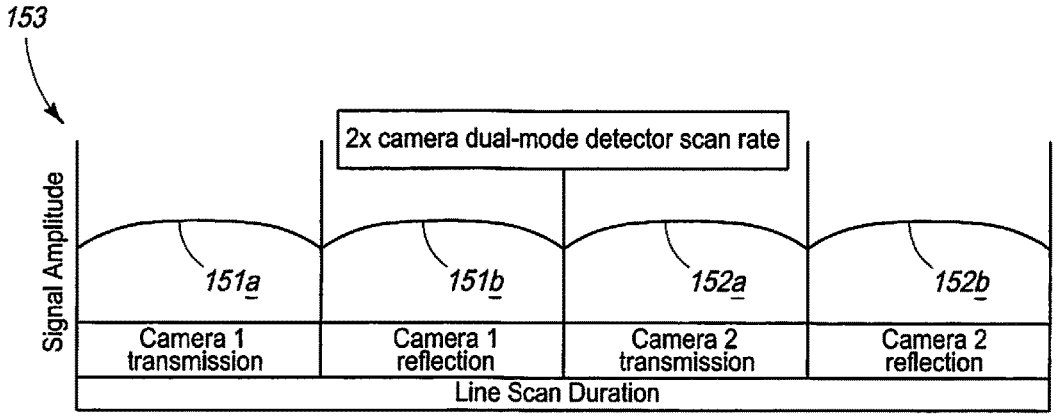
FIG. 6A is a greatly simplified, graphical depiction of the operation of the present invention as seen in FIG. 6.

Referring now to the sixth form of the invention, as seen in FIG. 6, the sixth form of the invention 150 includes first and second electromagnetic radiation detector cameras, which are indicated by the numerals 151 and 152, respectively, and which are positioned on opposite sides of the inspection station 33. The respective electromagnetic radiation detector cameras 151 and 152 each have two modes of operation, that being a transmission mode, and a reflective mode. As seen in FIG. 6A, the mode of operation of the sixth form of the invention 150 is graphically illustrated. In this form of the invention the two electromagnetic radiation detector cameras 151 and 152 are operated in a dual-mode detector scan rate. It will be noted that the duration of the detector camera actuation for transmission and reflection is substantially equal in time. The signal amplitude of the first detector camera 11 transmission mode is indicated by the line labeled 151*a*, and the signal amplitude of the first detector camera reflection mode is indicated by the numeral 151*b*. Similarly, the signal amplitude of the second detector camera transmission mode is indicated by the numeral 152*a*, and the signal amplitude of the second detector camera reflection mode is indicated by the numeral 152*b*. Again, the respective detector cameras, as disclosed in this paragraph, are operated in a coordinated temporal manner.

Figure 7:
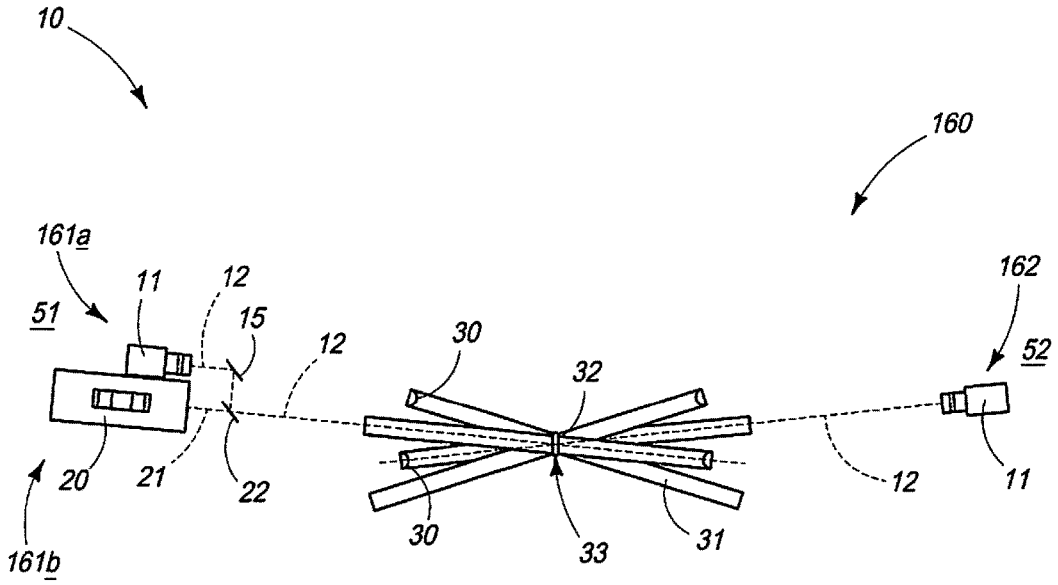
FIG. 7 is a greatly simplified, side elevation view of yet another form of the present invention.
Figure 7A:
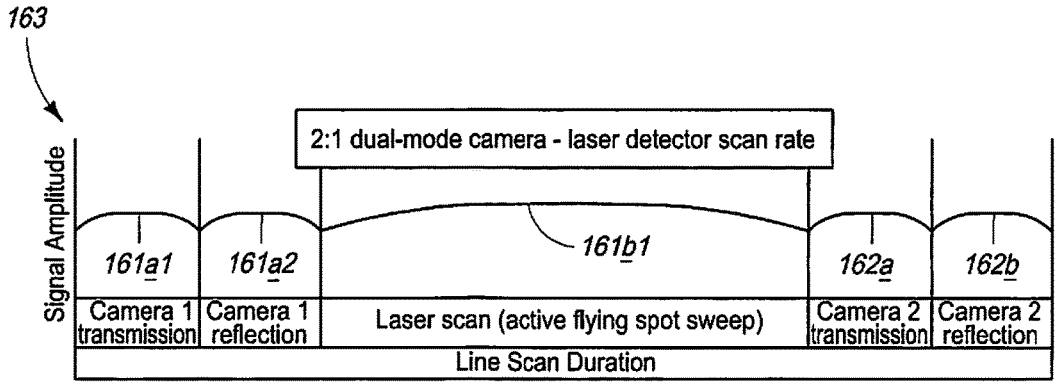
FIG. 7A is a greatly simplified, graphical depiction of the operation of the present invention as seen in FIG. 7.

Referring now to FIG. 7, a seventh form of the invention is generally indicated by the numeral 160 therein. In this greatly simplified form of the invention, a first electromagnetic radiation detector camera, and first electromagnetic radiation detector laser scanner combination 161*a* and 161*b* are provided, and which are positioned on one side 51 of the inspection station 33. On the opposite side 52 thereof, a second electromagnetic radiation detector camera 162 is provided. Referring now to FIG. 7A, and in one mode of operation 163 of the arrangement as seen in FIG. 7, the mode of operation 163 is graphically depicted as a 2:1 dual-mode electromagnetic radiation detector camera 161*a* and electromagnetic radiation detector laser scanner arrangement 161*b*. As seen in FIG. 7A, the respective electromagnetic radiation detector cameras 161A and 162, respectively, can be operated in either a transmission or reflection mode. As will be recognized by a study of FIG. 7A, the signal amplitude of the first electromagnetic radiation detector camera 161*a* in the transmission mode, is indicated by the numeral 161*a*1, and the signal amplitude of the reflection mode of the first electromagnetic radiation detector camera is indicated by the numeral 161*a*2. Further, the signal amplitude of the first electromagnetic radiation detector laser scanner 161*b*, is indicated by the numeral 161*b*1; and the signal amplitude of the transmission mode of the second electromagnetic radiation detector camera 162 is indicated by the numeral 162*a*. The signal amplitude of the reflection mode of the second electromagnetic radiation detector camera is indicated by the numeral 162*b*. Again, the advantages of the present invention 10 relates to the selective energizing and the selective actuation of the respective components, as described herein to inspect or interrogate a stream of products passing through the inspection station 33.

Figure 8:
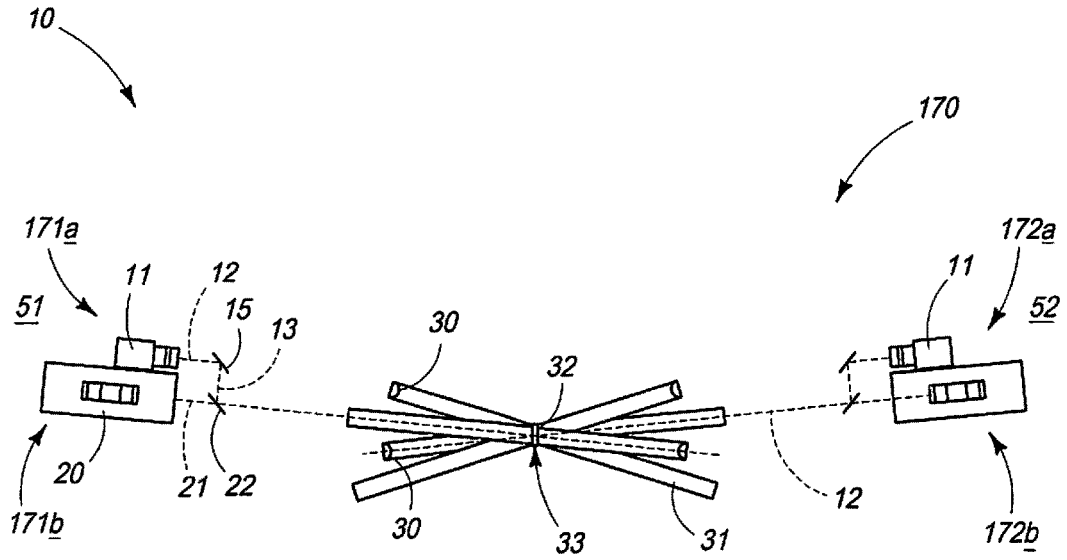
FIG. 8 is a greatly simplified, side elevation view of yet another form of the present invention.
Figure 8A:
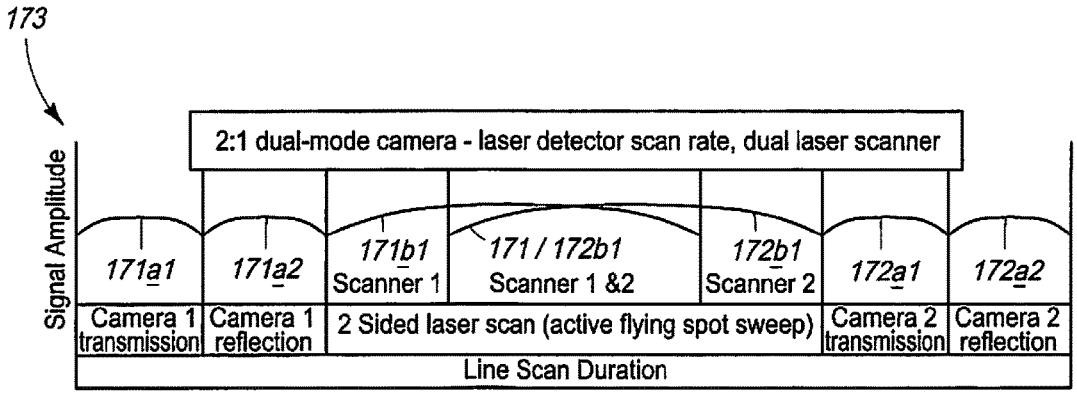
FIG. 8A is a greatly simplified, graphical depiction of the present invention as seen in FIG. 8 during operation.

Referring now to FIG. 8, an eighth form of the invention is generally indicated by the numeral 170. The eighth form of the invention includes, as a first matter, a first electromagnetic radiation detector camera 171*a*, and a first electromagnetic radiation detector laser scanner 171*b*, which are each positioned in combination, and on one side 51 of the inspection station 33. Further, a second electromagnetic radiation detector camera 172*a* and second electromagnetic radiation detector laser scanner combination 172*b*, are located on the opposite side 52 of the inspection station 33. As seen in FIG. 8A, a mode of operation is graphically depicted for the eighth form of the invention 170. As seen in that graphic depiction, a 2:1 dual mode detector camera-laser detector scan rate, and dual laser scanner operation can be conducted. As with the other forms of the invention, as previously illustrated, and discussed, above, the first detector camera 171*a*, and second detector camera 172*a*, each have a transmission and reflection mode of operation. Consequently, when studying FIG. 8A, it will be appreciated that the line labeled 171*a*1 represents the signal amplitude of the first electromagnetic radiation detector camera transmission mode, and the line labeled 171*a*2 is the first electromagnetic radiation detector camera reflection mode. Similarly, the signal amplitude of the second electromagnetic radiation detector camera transmission mode is indicated by the line labeled 172*a*1, and the second electromagnetic radiation detector camera reflection mode is indicated by the line labeled 172*a*2. The signal amplitude, over time, of the respective components, and in particular the first and second electromagnetic radiation detector laser scanners, are indicated by the numerals 171*b*1 and 172*b*1, respectively.

Figure 9:
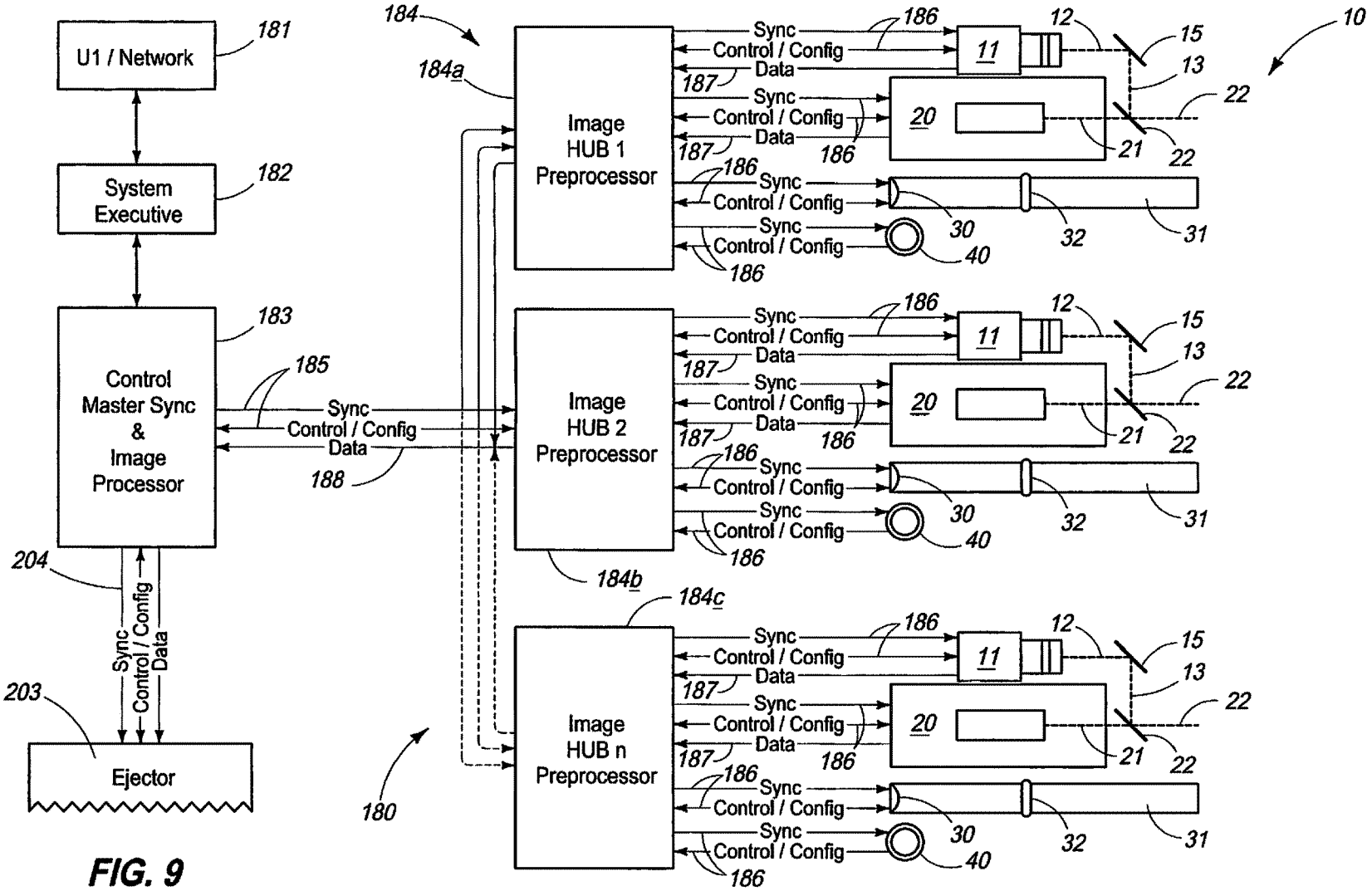
FIG. 9 is a greatly simplified, schematic diagram showing the major components, and working relationship of the components of the present invention which implement the methodology as described, hereinafter.
Figure 10:
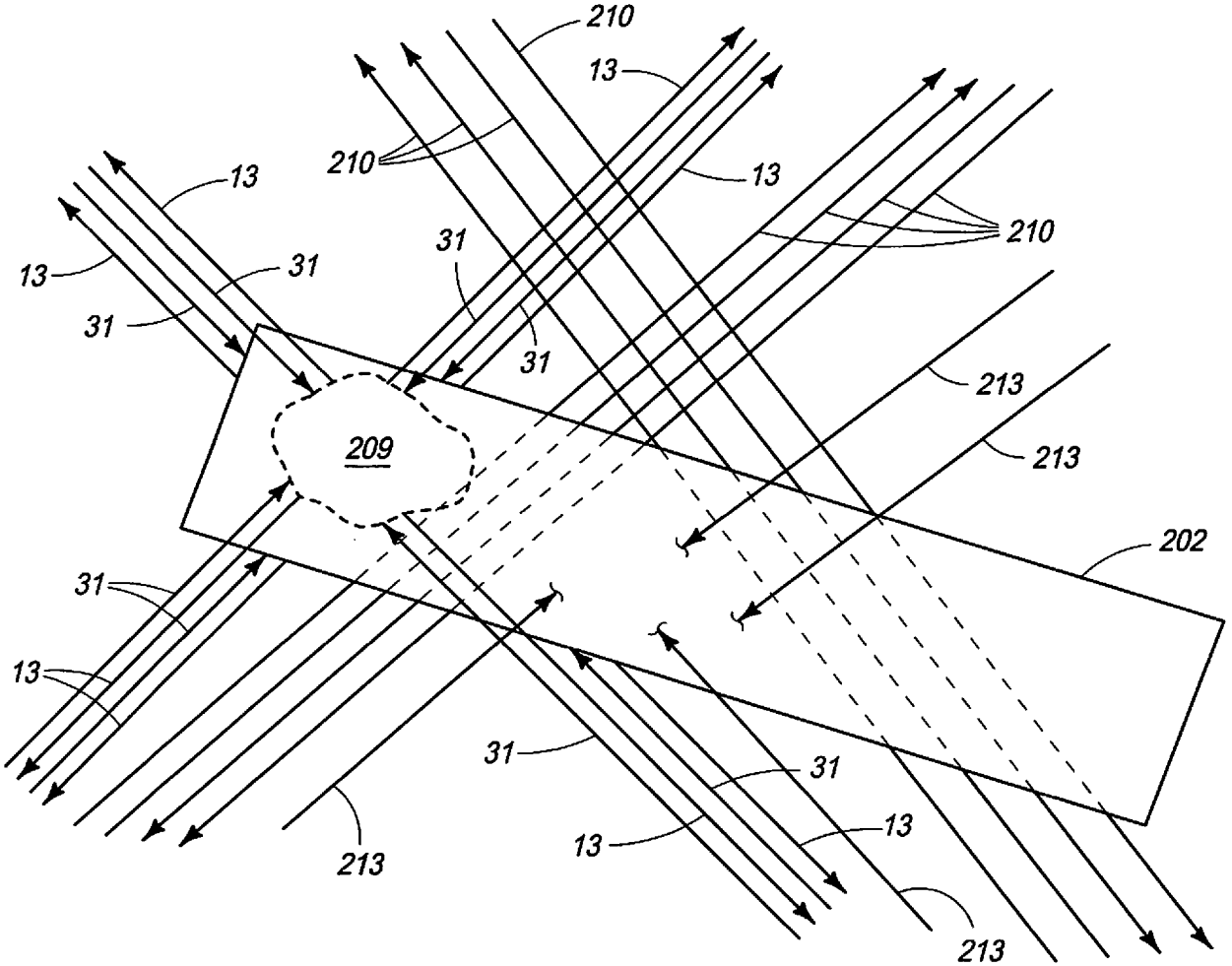
FIG. 10 is a simplified artistic illustration of an individual item of interest being irradiated by electromagnetic radiation from various directions, and showing the electromagnetic radiation waves being reflected from external characteristics of the individual item of interest; being reflected from internal characteristics of the individual item of interest; being transmitted through the individual items of interest; and being absorbed by the object of interest.

Referring now to FIG. 9, a greatly simplified schematic view is provided, and which shows the operable configuration of the major components of the present apparatus, and which is employed to implement the methodology of the present invention 10. With regard to FIG. 9, it will be recognized that the apparatus and methodology 10 includes a user interface or network input device, which is coupled to the apparatus 10, and which is used to monitor operations and make adjustments in the steps of the methodology, as will be described, below. The control arrangement, as seen in FIG. 9, and which is indicated by the numeral 180, includes the user interface 181, and which provides control and configuration data information, and commands to the apparatus 10, and the methodology implemented by the apparatus. The user interface 181 is directly, electrically coupled either by electrical conduit, or by wireless signal to a system executive 182, which is a hardware and software device, which is used to execute commands provided by the user interface 181. The system executive 182 provides controlling and configuration information, and a data stream, and further is operable to receive images processed by a downstream image processor, and master synchronous controller which is generally indicated by the numeral 183. As should be understood, the "System Executive" 182 hosts the user interface, and also directs the overall, but not real-time, operation of the apparatus 10. The System Executive 182 stores assorted, predetermined, executable programs which cause the selective activation of the various components which have been earlier described. The controller 183 is operable to provide timed, coordinated predetermined signals or commands in order to actuate the respective electromagnetic radiation detector cameras 11, electromagnetic radiation detector laser scanners 20, electromagnetic radiation emitter illumination assemblies 30, and backgrounds 40 as earlier described, in a coordinated predetermined order, and over given predetermined time periods so as to effect the generation of device signals, as will be discussed below, and which can then be combined and manipulated by multiple image preprocessors 184, in order to provide real-time data, which can be assembled into a useful data stream, and which further can provide real-time information regarding internal and external features and characteristics of the stream of products moving through the inspection station 33.

As indicated above, the present control arrangement 180 includes multiple image preprocessors here indicated by the numerals 184*a*, 184*b* and 184*c*, respectively. As seen in FIG. 9, the command and control, and synchronous control information is provided by the controller 183, and is supplied to each of the image preprocessors 184*a*, 184*b* and 184*c*, respectively. Further it will be recognized that the image preprocessors 184*a*, 184*b* and 184*c* then provide a stream of synchronous control, and control and configuration data commands to the respective assemblies, such as the electromagnetic radiation detector camera 11, electromagnetic radiation detector laser scanner 20, electromagnetic radiation emitter illumination device 30, and/or background 40, as individually arranged, in various angular, and spatial orientations on opposite sides of the inspection station 33. This synchronous, and control and configuration data allows the respective devices, as each is described, above, to be switched to different modes; to be energized and de-energized in different time sequences. When rendered operational, the various electrical devices, and sensors which include electromagnetic radiation detector cameras 11; electromagnetic radiation detector laser scanners 20; electromagnetic radiation emitter illumination devices 30; and backgrounds 40, provide device signals 187, which are delivered to the individual image preprocessors 184*a*, 184*b* and 184*c*, and where the image pre-processors are subsequently operable to conduct operations on the supplied data in order to generate a resulting data stream 188, which is provided from the respective image pre-processors 184*a*, 184*b* and 184*c* the controller 183 and image processor. The image processor and controller 183 is then operable to effect a decision making process in order to identify defective or other particular features of individual products passing through the inspection station 33, and which could be either removed by an ejection assembly, as noted below, or further diverted or processed in a manner appropriate for the feature identified, such as for sorting the objects by grade or predetermined quality characteristics.

As seen in the drawings, the current apparatus and method 10 includes, in one possible form, a conveyor 200 for moving individual products 201 in a nominally continuous bulk particulate stream 202, along a given path of travel, and through one or more automated inspection stations 33, and one or more automated ejection stations 203. As seen in FIG. 9, the ejection station 203 is coupled in signal receiving relation 204 relative to the controller 183. The ejection station 203 is equipped with an air ejector of traditional design, and which removes predetermined individual objects 201 from a product stream 202 through the release of pressurized air.

A sorting apparatus 10 for implementing the steps, which form the methodology of the present invention, are seen in FIG. 1A and following. In this regard, the sorting apparatus and method 10, of the present invention, includes a source of individual products 201, and which have multiple distinguishing features. Some of these features may be hidden or internal or otherwise may not be easily discerned visually, in real-time in a fast moving product stream. The sorting apparatus 10 further includes a conveyor 200 for moving the individual products 201, in a nominally continuous bulk particulate stream 202, and along a given path of travel, and through one or more automated inspection stations 33, and one or more automated ejection stations 203.

The sorting apparatus 10 further includes a plurality of selectively energizable electromagnetic radiation emitter illumination devices 30, and which are located in different spaced, angular orientations in the inspection station 33, and which, when energized, emit beams/waves of electromagnetic radiation 31 of predetermined wavelengths, which is directed toward the stream of individual products 202, such that the electromagnetic radiation 31 is reflected, refracted, transmitted or absorbed by the individual products 201, as they pass through the inspection station 33. The apparatus 10 further includes a plurality of selectively operable electromagnetic radiation detection devices 11, and 20, which are located in different, spaced, angular orientations relative to the inspection station 33. The electromagnetic radiation detection devices 11, 20 provide multiple modes of non-contact, non-destructive interrogation of reflected, refracted, absorbed or transmitted electromagnetic radiation 31, to identify various features and characteristics (internal and external) of the respective individual objects 201. Some of the multiple modes of non-contact, non-destructive product interrogation, if operated continuously, simultaneous and/or coincidently, interfere with other interrogation signals formed from the products 201, which are interrogated. The apparatus 10 further includes a configurable, programmable, multi-phased, synchronizing interrogation signal acquisition controller 183, and which further includes an interrogation signal data processor and which is operably coupled to the electromagnetic radiation emitter/illuminator 30 and electromagnetic radiation detection devices 11, 20, respectively, so as to selectively energize electromagnetic radiation emitter illuminators 30, 40, and selectively actuated electromagnetic radiation detection devices 11 and 20, in a programmable, coordinated predetermined order which is specific to the products 201 which are being inspected so as to preserve and enhance spatially correlated, and pixilated, real-time, interrogation signal data from each actuated electromagnetic radiation detection device 11 and 20, and which is supplied to the controller 183, as the individual objects 201 pass through the inspection station 33. In the arrangement as seen in the drawings, the integrated image data preprocessor 184 combines the respective device signals 187 through a sub-pixel level correction of spatially correlated image data from each selectively actuated electromagnetic radiation detection device 11, 20 to form real-time, continuous, multi-modal, multi-dimensional digital images 188 representing the product flow 202, and in which multiple dimensions of the digital data, indicating distinguishing features and characteristics of said products, is generated. The apparatus 10 also includes a configurable, programmable, real-time, multi-dimensional interrogation signal processor system executive 182, and which is operably coupled to the controller 183, and image pre-processors 184. This assembly identifies products 201, and product features and characteristics from contrasts, gradients and pre-determined ranges, and patterns of values specific to the products 201 being interrogated, and which is generated from the pre-processed continuous interrogation data. Finally, the apparatus has one or more spatially and temporally targeted ejection devices 203, which are operably coupled to the controller 183 and system executive 182 to selectively redirect selected products 201 within the stream of products 202, as they pass through an ejection station 203.

The method and apparatus for sorting described herein has had significant commercial success in the marketplace for the sorting of bulk particulate. Continued observations, refinements and widespread adoption however has led to the recognition that the instant invention can be materially improved.

As is described, sorting decisions, wherein unacceptable objects of interest 209 are separated from the acceptable objects of interest 202 moving in a product stream 201, are based upon contrasts within and between the objects of interest 202. The contrasts include both internal and exterior characteristics of the individual objects 202 and further may include color, texture, light reflectance, light refraction, light absorbance, light transmittance, light translucence, opaqueness, and the like.

The improvement invention herein intentionally creates measured laser scanner 20 signal interference, which has the effect of elevating scanner signal amplitudes as noise. So long as this elevated interference is measurable/controllable and also leaves sufficient remaining laser scanner dynamic range (signal-to-noise ratio) for useful scanner images/interrogation signals, then it is possible to compensate for the interference with the controller 183. The improved result is a compensated impact on laser scanner 20 signals while providing significantly more time (up to 2× more time) available for the camera detector 11 exposures. Thus, the camera signal amplitude increases, providing greater signal-to-noise ratio, while the affected laser scanner 20 signals remain usable through compensation of the known/allowed interference.

When greater contrast is available for making a sorting decision, better and more precise sorting decisions can be made. For example, certain varieties of potato may have an acceptable dark yellow color of the potato "meat" and yet the same variety of potato may have an outer "skin" color that is a yellowish-brown. The presence of potato skin on a piece of potato may render that particular piece of potato an unacceptable object 209. The contrast between dark yellow and yellowish-brown is minimal and therefore difficult for an automated sorting apparatus and method. Another example where increased contrast is desirable is with polarization response. It is known that polarization contrast is higher when reflection is weak. Therefore, in order to generate high contrast polarization images/signals, the wavelengths that are most absorbed by the objects of interest 202 in the stream 201 must be selected. Because of the high levels of wavelength absorption, there is little/weak reflection of electromagnetic radiation and therefore increasing the time period during which the reflected electromagnetic radiation waves are detected by the detection devices 11, 20 allows enhancement of the contrast. As an example, with an object such as a raisin, there is high absorption in the blue wavelength band/spectrum (the complementary color of green) and therefore the highest polarization is in the blue channel. Therefore, it is desirable to increase the contrast by increasing the exposure time in order to facilitate better and more precise sorting decisions.

To enhance otherwise subtle contrasts between similar colors, and polarization, camera image dynamic range (known as signal-to-noise ratio) must be increased. Increased signal-to-noise ratio can be accomplished by increasing the time of duration of the camera detector 11 exposure so that more energy is detected/collected.

The total time period available for carrying out the multiple various steps of the instant invention is limited and fixed by the geometry of the apparatus. Distances are small and, to be functional, the plurality of steps must occur in real time. Therefore, any increase in the time period for detection device 11, 20 actuation requires a temporal overlap with another selectively energized emitter/illuminator 30, 40 and/or another selectively actuated detection device 11, 20. Spectral overlap may also occur by emitters/illuminators 20, 30, 40 emitting bands/spectrums of electromagnetic radiation.

Figure 13:
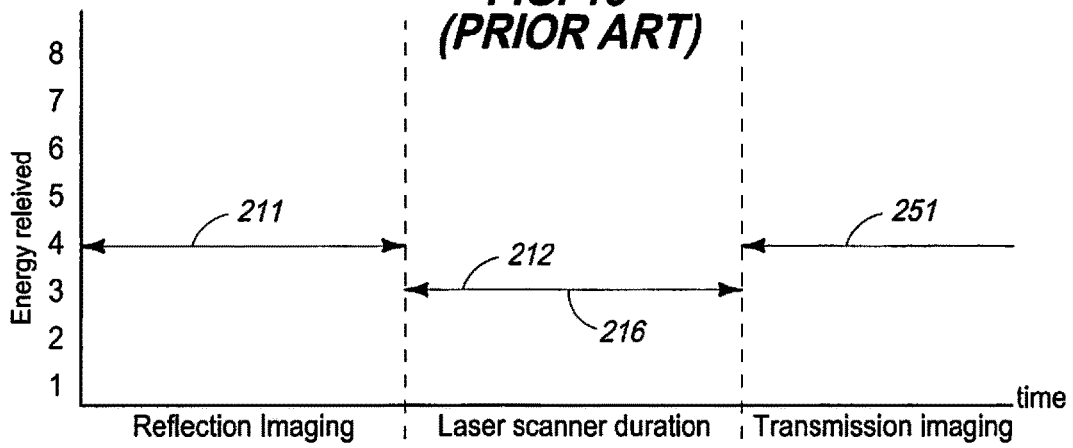
FIG. 13 (PRIOR ART)
FIG. 13 is a greatly simplified, graphical depiction of the prior art invention showing the complete temporal separation of the imaging/detection modes.

In the earlier form of invention, contrast was increased by providing complete separation of the emitters/illuminators 30 and the detectors 11, 20 by a combination of temporal, spectral and spacial separating means, so as to avoid all interference between the interrogation signals 187. (FIG. 13).

The improved invention herein is achieved by increasing/enlarging/lengthening the period of time during which select selectively energized electromagnetic radiation emitters/illuminators 20, 30, 40 are energized and select electromagnetic radiation detection devices 11, 20 are selectively actuated, and intentionally creating a known interference (a temporal overlap) in the interrogation signals 187.

The simultaneous energizing of plural emitters/illuminators 20, 30, 40 while simultaneously selectively actuating plural electromagnetic radiation detection devices 11, 20 causes interference because at least one such detection device 11, 20 is receiving electromagnetic waves 31 from more than one emitter/illuminator 20, 30, 40, 240.

Figure 16:
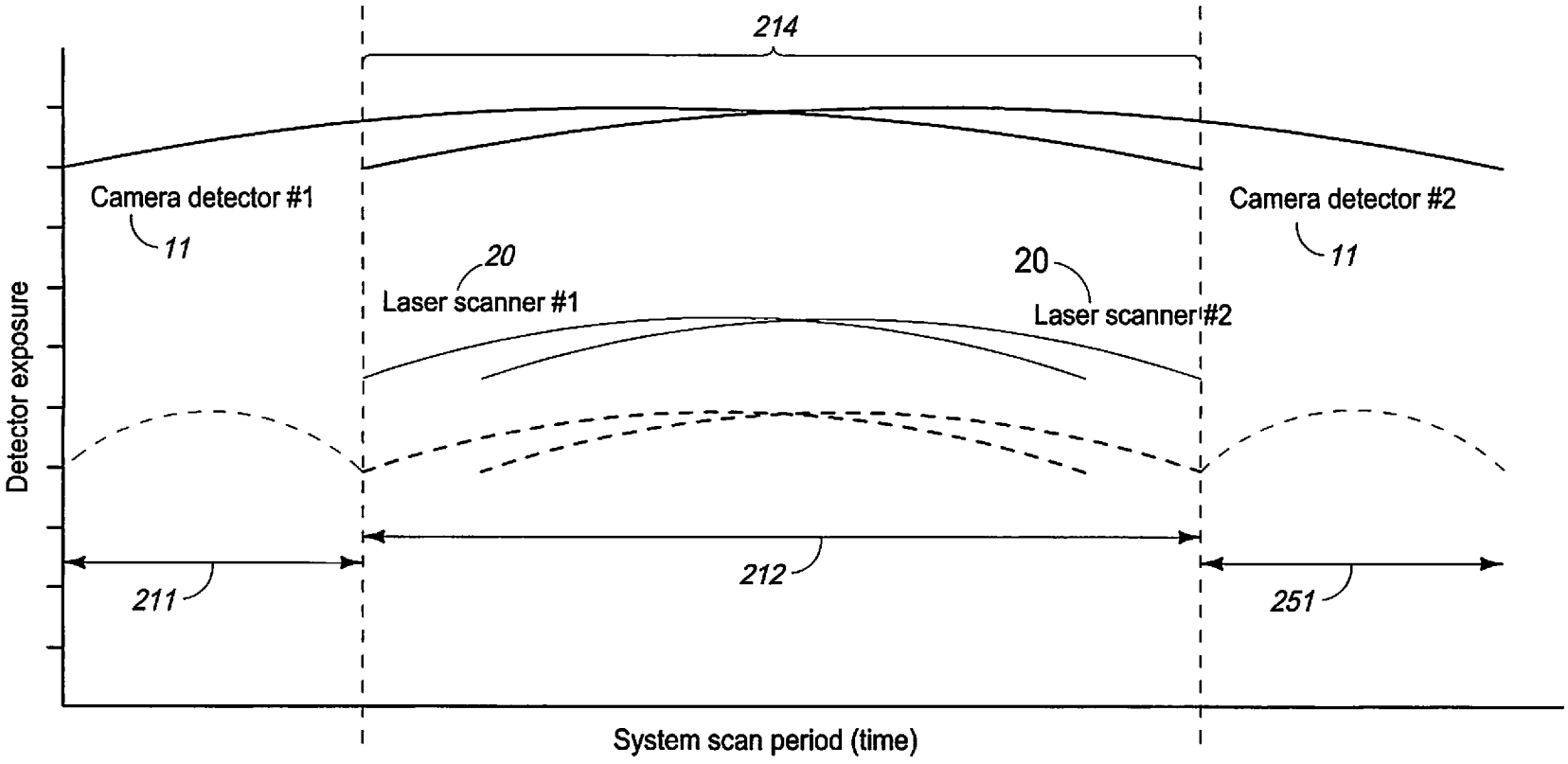
FIG. 16 is a greatly simplified graphical depiction of another form of the instant improved invention showing the temporal overlap of laser scanners with two camera type detectors.

The improved and enhanced contrast is achieved by intentionally and fully or partially overlapping 214 the periods of time during which plural selectively energized emitters/illuminators 30, 40 are energized 211, 212, 251 and while plural selectively actuated electromagnetic radiation detection devices 11, 20 are simultaneously actuated. (FIGS. 13A, 13B and FIG. 16).

For purposes of this patent disclosure, the intentional temporal overlap 214 is described with reference to FIGS. 13, 13A and 13B and 16.

FIG. 13 is Prior Art and shows the earlier form of the inventive method for sorting with complete temporal separation between camera reflection imaging, laser scanning, and camera transmission imaging with a representative signal strength plotted against time. Camera reflection imaging duration is represented by the numeral 211. Laser scanner duration is represented by the numeral 212, and the camera transmission imaging (from an emitting active background 40) is represented by the numeral 251. The camera reflection imaging 211 has a temporal duration with a beginning and an end. Immediately after the camera reflection imaging duration 211 ends, the laser scanner duration 212 begins and extends for a predetermined period of time to an end. Immediately after the laser scanner duration 212 ends, a camera transmission imaging duration 251 begins and extends to an end. (Not shown). The respective durations 211, 212, 251 are sequential in order and have no temporal overlap. Each device 11, 20 actuation period collects an amount of energy during the duration that represents a signal strength/signal amplitude. (The scale shown on the vertical axis of FIGS. 13, 13A and 13B is for illustrative purposes only, and does not represent any particular signal).

Figure 13A:
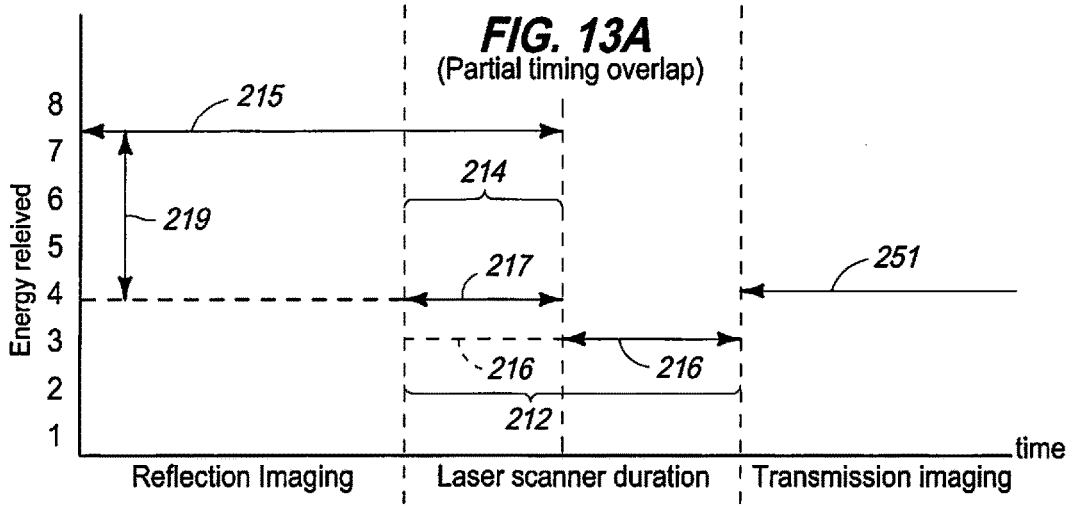
FIG. 13A is a greatly simplified, graphical depiction of one embodiment of the instant improved invention showing a partial temporal overlap of the reflection imaging and the laser scanner duration with a resulting signal amplitude increase for both detectors.
Figure 13B:
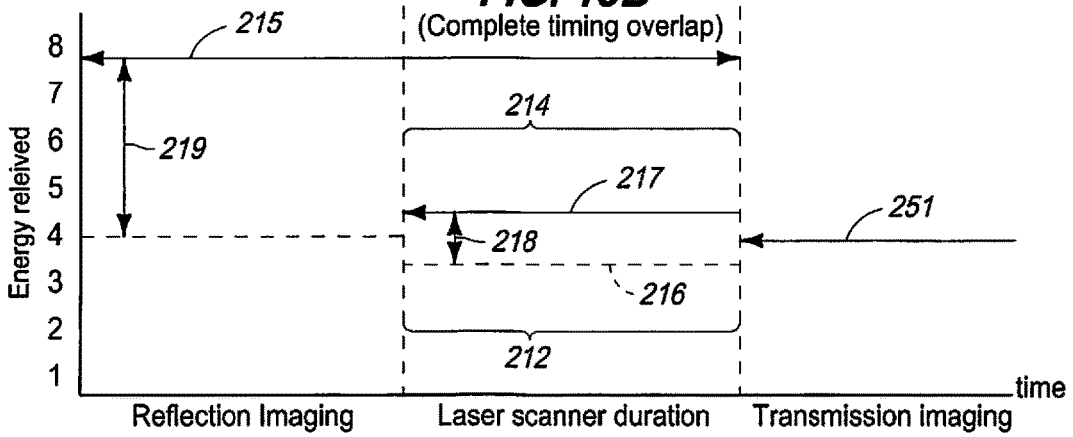
FIG. 13B is a greatly simplified, graphical depiction of a second embodiment of the instant improved invention showing complete temporal overlap of the reflection imaging and the laser scanner duration with a resulting signal amplitude increase for both detectors.

FIG. 13A shows a first version of the improvement invention herein with a partial temporal overlap between the camera reflection imaging 215 and the laser scanning duration 212, with energy received plotted against time. As can be seen, the duration 215 of the camera reflection imaging is longer/greater than duration 211 of FIG. 13 by overlap period 214. The period of overlap 214 increases the exposure time of the respective camera detector 11 and results in a material increase in signal amplitude for the camera detector 11 because more energy is detected/collected. The increased signal amplitude is represented by 219.

The timing overlap 214 (FIG. 13A) creates interference or "noise" in the signals received by both of the camera detector 11 and the laser scanner 20 because both detection devices 11, 20 received energy/light from the two simultaneously operating emitters/illuminators 20, 30, 40. For purposes of this patent application, the term "Noise" is defined as a component of a detector signal that does not most accurately indicate the measured quantity/characteristic of the object of interest.

The partial temporal overlap 214 shown in FIG. 13A however creates complexities in compensating for the intentionally created "noise" because of the manner in which laser scanners 20 operate. When there is a partial temporal overlap 214 of camera type illumination 30 that does not completely overlap the entire laser scanner duration 212, there is a change 218 in laser signal strength at some instant in time between the beginning of the laser scanner duration 212 and the end of the laser scanner duration 212 (FIG. 13A line 217 compared to 216). Because of the change 218 in signal strength that occurs during the laser scanner duration 212, it is necessary to calculate exactly when and where the signal strength changes during the laser scanner duration 212. Because laser scanners 20 operate at such high speeds and at the pixel level, the signal change (i.e. when the camera illumination 30 turns on or off) must be a precisely identified and a compensation (a signal component representing the difference in signal amplitude 218) must be applied by the controller 183 only to those particular pixel related signals that have the increased amplitude. Such calculations and compensation is possible and feasible, only with a high speed, synchronous, phase controlled system that can be made to respond to pixel values with nanosecond precision. The improved invention herein is capable of run-time compensation such as that required by partial overlap, although a method for compensating full/complete overlap that does not necessarily require such complex compensation is also described herein.

FIG. 13B is similar to FIG. 13A but represents a full/complete temporal overlap 215 of the laser scanner duration 212 by the camera emitters/illuminators 30, 40. Similarly, the signal amplitude of the camera detector 11 reflection imaging is materially increased 219 which provides greater contrast in the resulting interrogation signal 187 because more energy is collected. The laser scanner signal amplitude 217 is similarly increased 218 from its beginning to its end, but because the increased signal amplitude 217 extends the full duration 212 of the laser scan, it is possible to compensate the laser scanner signal amplitude 217 by a compensation representing the increase 218. It is not necessary to determine the exact time and the exact pixel location of signal amplitude change as is the case with the partial temporal overlap described above with reference to FIG. 13A. The compensation is predetermined and is applied to the entire laser scanner 20 interrogation signal 187 by the controller 183, which preserves the useful dynamic range of the laser scanner signal. The result of complete/full temporal overlap is that the camera interrogation signal 187 is much greater/stronger 219, which provides for significantly increased contrast, and the laser scanner interrogation signal 187 is preserved to remain usable. The net effect is overall increased contrast for making better and more precise sorting decisions.

The temporal overlap 214 increases the amount of light energy (electromagnetic radiation) received by both the camera detector 11 and the laser scanner 20. The increased energy level is represented by lines 218, 219 in FIGS. 13A, 13B.

The temporal overlap 214 however causes an interference in the interrogation signals 187 of both the camera detector 11 and the laser scanner 20. The interference/noise is detected/received by both detection devices 11, 20 and can be calculated, and is therefore "a known". The effect of the "noise" received by the camera detector 11 is that the additional electromagnetic radiation energy received by the camera detector 11 is "spread out" amongst all the photoreceptor pixels within the camera detector 11 array (not shown) and is represented within the interrogation signal 187. The effect of the "noise" received by the laser scanner 20 causes the line of pixels being examined by the laser scanner 20 to have a higher amount of energy, and therefore a higher signal amplitude 218. The known interference/noise is calculated by the controller 183 (FIG. 17) into a compensation which is then applied to the interrogation signals 187 by the controller 183 so as to optimize the interrogation signal 187. By optimizing the interrogation signal 187, the interference/noise is essentially "removed" from the interrogation signal 187, which results in a usable laser scanner 20 interrogation signal 187.

Figure 14:
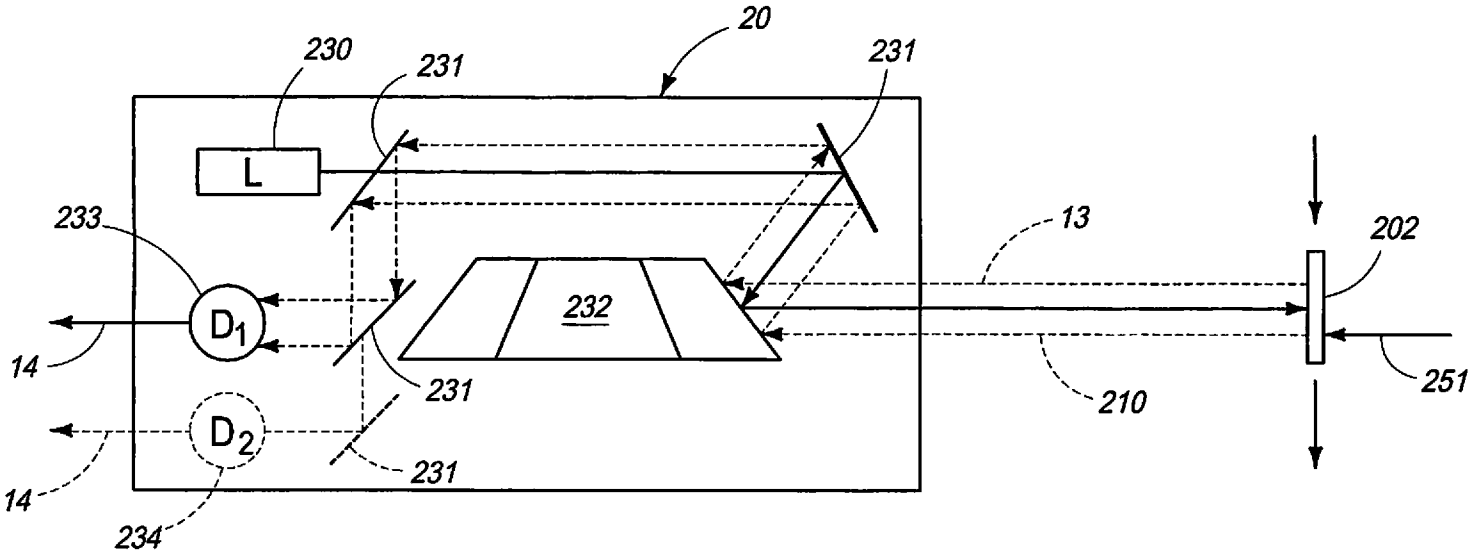
FIG. 14 is a greatly simplified, cross-sectional depiction of the various components of a laser scanner having two laser light detectors for detecting different wavelengths of light.
Figure 15:
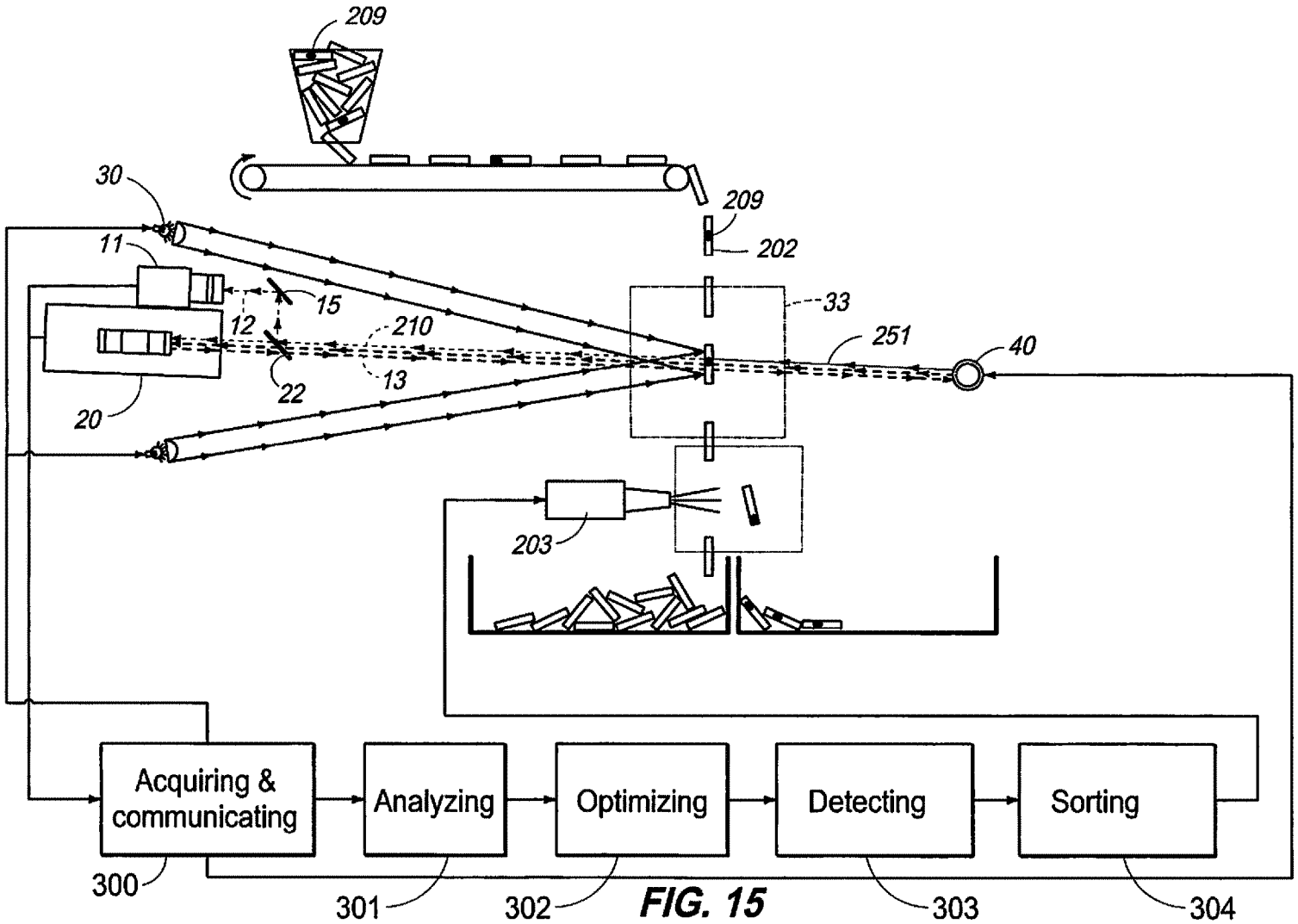
FIG. 15 is a greatly simplified artistic representation of one form of the instant improved invention employing both reflection imaging and transmission imaging utilizing foreground illumination and an active background.

An overall net gain in contrast is achieved because the laser scanner channels are partially (and significantly) protected from camera illumination by the dichroic 'mix mirror' that joins camera and laser scanner optical axes into one. (FIG. 14). Because these dichroic filters are not perfect, and because camera illuminators commonly 'spill over' into laser wavelengths, there is some optical 'overlap' noise between camera detector 11 and laser scanner 20 channels. The amount of noise is limited by the optical system. A properly selected intentional introduction of reflections of camera illumination do not produce a large increase in laser scanner signal amplitude. This is critical, because a large increase in laser scanner signal amplitude could leave insufficient dynamic range remaining to support desirable contrast based on the primary laser light interaction with objects of interest 202 for sorting. The compensation corrects and restores signal level only within the laser scanner's 20 absolute dynamic range. The amount of selected noise amplitude increase is kept small, because much of the camera illumination 30 is be blocked by the dichroic 'mix mirror'.

For simplicity, FIGS. 13A and 13B only illustrate temporal overlap between a single camera detector 11 during reflection imaging 211, 215, and a single laser scanner 20 during reflection imaging 212. However, it is to be expressly understood that the invention disclosed herein is not limited thereto and may also incorporate plural camera detectors 11 and plural laser scanners 20 all operating in a reflection mode, and/or in a transmission mode. The instant invention further expressly incorporates one or more active backgrounds 40 and/or one or more passive backgrounds 40. It is further expressly contemplated that there may be multiple intentional interferences and that the temporal overlap 214 may occur at or near, the beginning of the duration, at or near, the end of the duration or between the beginning and the end of the duration. (FIG. 16).

Camera illuminators 30 utilize relatively broad wavelength spectrums or bands of electromagnetic radiation that encompass a variety of different colors. (Electromagnetic radiation bands/spectrums). When the camera illumination electromagnetic wavelengths/spectrums are similar to, or overlap the wavelengths of the laser detectors 20, signal interference, or noise, occurs because both the camera detector 11 and the laser detector 20 detect and receive the same reflected, refracted, transmitted, fluoresced or absorbed electromagnetic radiation waves 31 that have the same/a similar wavelength. As a result, the interrogation signal 187 generated by the camera detector 11, and the interrogation signal 187 generated by the laser detector 20, which are both communicated to the controller 183, share at least partially overlapped wavelengths of light for some period of time because both detection devices 11, 20 are detecting and receiving, at least partially, the same electromagnetic wavelengths 31. Further, the detection devices 11, 20 are not able to distinguish whether the detected and received electromagnetic waves 31 are being reflected from the object of interest 201 being interrogated, only by the illumination device 30, 40, 240 primarily associated with the particular detection device 11, 20 or whether the detected and received electromagnetic waves 31 are instead originating from the other electromagnetic radiation generating component. (Laser emitter 20, illumination device 30, or active background 40).

By means of the controller 183, the illumination devices 30, 40, 240 and the camera detectors 11 and laser detectors 20 are operated in a predetermined coordinated pattern so that a predetermined amount of temporal overlap 214 is intentionally created. Because the predetermined temporal overlap 214 is intentionally created, the resulting noise (signal interference) can be pre-calculated and is therefore "known" for each individual type of product being sorted. The signal interference (noise) created by the overlapping operation of selected illuminators/detectors is then "compensated for" in the resulting interrogation signal 187 to increase contrast.

Figure 11:
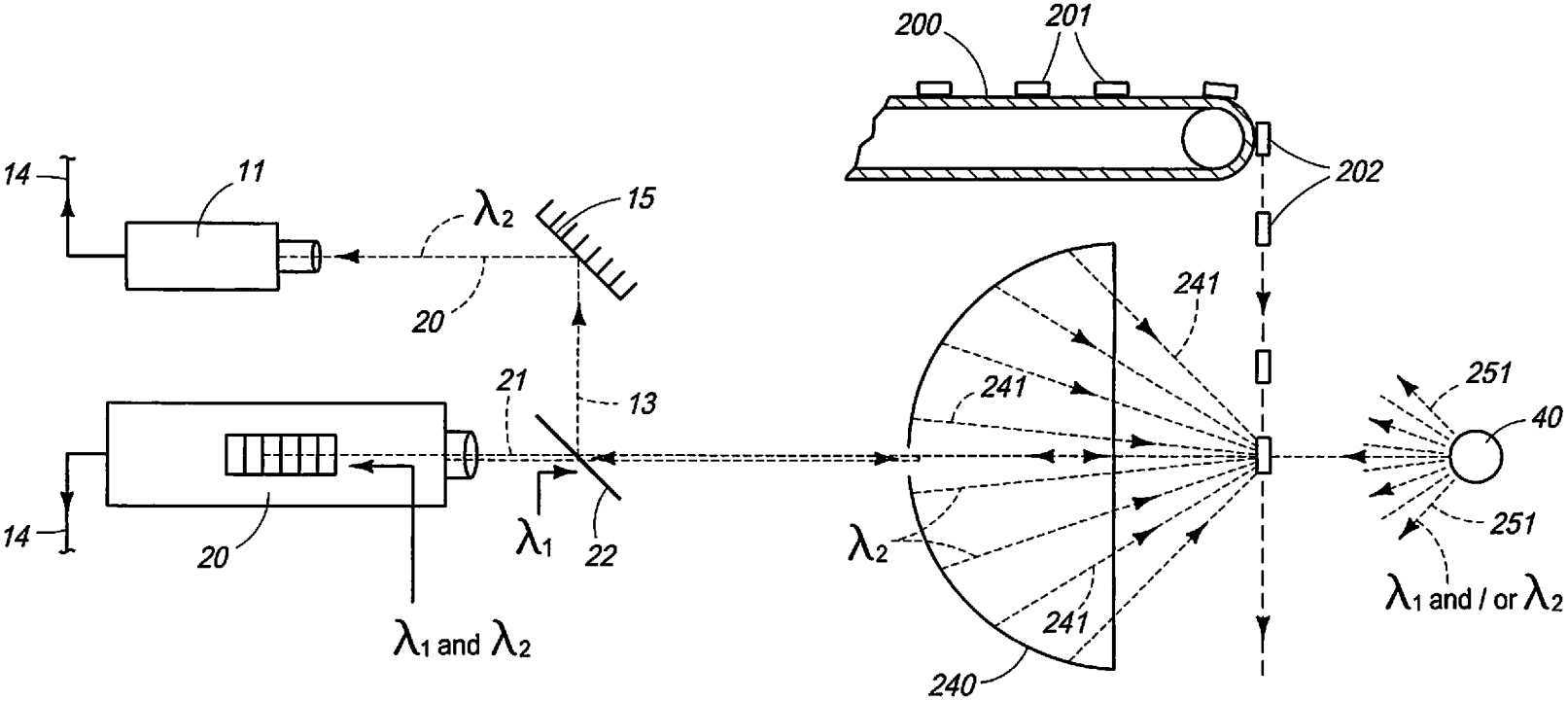
FIG. 11 is an artistic illustration of an improved form of the present invention showing a one sided "cloudy day" type illumination irradiating an individual object of interest to eliminate shadows and also showing an active background emitting electromagnetic radiation for transmission imaging.
Figure 12:
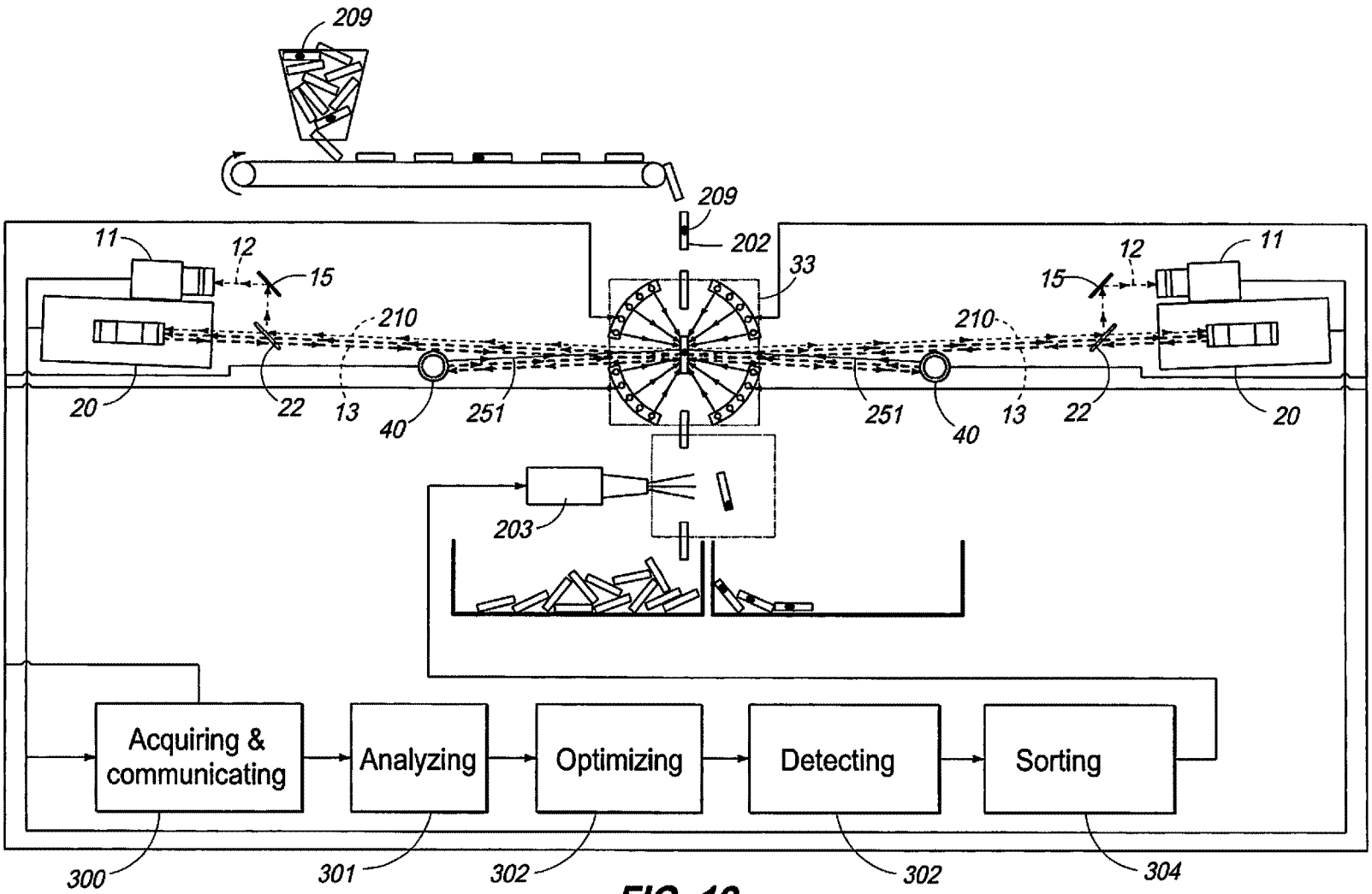
FIG. 12 is an artistic illustration of another improved form of the present invention showing a two sided "cloudy day" type illumination irradiating an individual object of interest to eliminate shadows and also showing two active backgrounds emitting electromagnetic radiation for transmission imaging.

As shown in FIGS. 11 and 12, foreground illumination and background illumination may be configured as "cloudy day" like illumination from one or more hemispherical or semi-cylindrical illumination sources 240. Such an illumination configuration, alone or in combination with an intentional interference, can reduce shadows and/or silhouettes formed within or on some three-dimensional objects of interest 202 passing through the inspection station 33. When combined with passive backgrounds 40, reflection imaging is received from both opposing sides of the inspection station 33. When active backgrounds 40 are utilized, transmission imaging may be achieved as well as reflection imaging.

Figure 17:
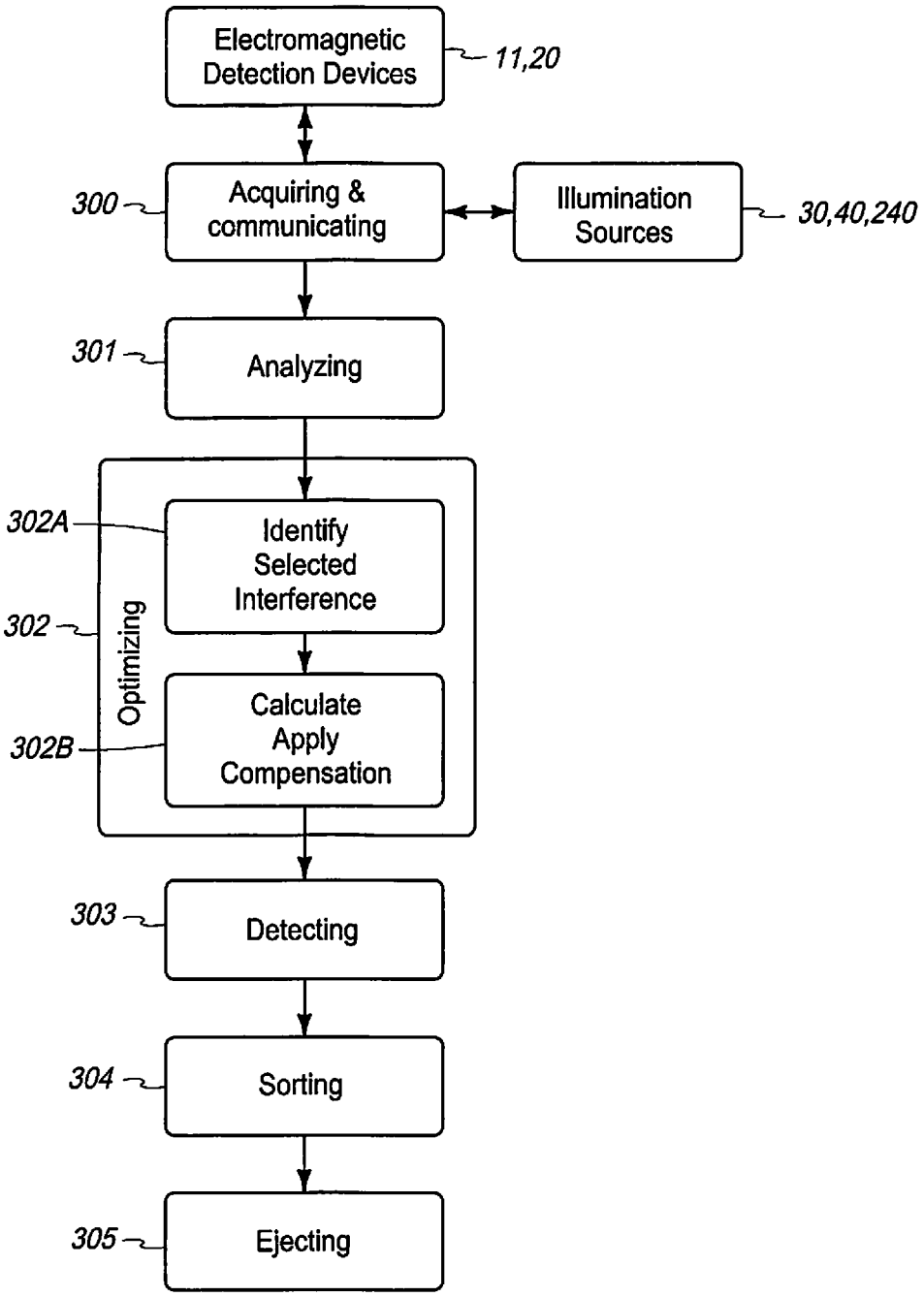
FIG. 17 is a block diagram showing the method steps of the instant invention.

FIG. 17 is a block diagram setting forth the process steps of determining and implementing the compensation and implementing the instant method.

The first step 300 is communication between the controller 183, the preprocessors 184, the plural electromagnetic radiation detection devices 11, 20 and the plurality of selectively energizable illumination sources 30, 40, 240. In the process of the communication, interrogation signals 187 are acquired by the controller 183 and the preprocessors 184.

In the second step 301, the interrogation signals 187 are analyzed by the controller 183 and/or preprocessor 184.

In the third step 302 the optimizing occurs. The optimizing uses both off-line preparation 302A of compensations and run time calculations 302B. The off-line preparation 302A of compensations includes measuring selected interferences during system set up using reflective and translucent calibration targets; measuring the electromagnetic radiation response such as reflectance/translucence from the targets; building a product recipe (not shown) that is specific to the individual type of product to be sorted; and generation of a compensation based upon the product recipe and the measurements from the calibration targets. The runtime calculations 302B, which occur during sorting operations, include identifying objects of interest 202 within the product stream 201 and optionally detecting various internal and external characteristics of the objects of interest 202 prior to final runtime compensation; detecting and measuring any interference and/or "halo" that is detected around the perimeter of any object of interest 202; calculating the compensation necessary based upon the interference and/or "halo" based upon each object of interest 202; combining the compensation received from the runtime examination 302B with the off-line/pre-calculated compensation 302A; and applying the compensation to the interrogation signal 187.

During runtime 302B, the pre-calculated compensation and any_runtime compensation are combined and applied to optimize the effect of the selected interference and prepare the interrogation signal 187 for further processing. In the event no runtime compensation is required or appropriate, pre-calculated compensation may be applied without an additional runtime calculated compensation. Compensations are made by applying coefficients directly to image pixel values, by the use of look up tables (LUT) stored within the controller 183, and/or by calculating a compensated pixel values based on neighborhood operations such as morphology or convolutions. The exact application of calculations to optimize images from selected interference can vary by sorting application and type of object of interest 202 being sorted. (e.g. raisins vs. green beans vs. potato strips).

In the fourth step 303, the multitude of internal and external characteristics of each of the individual objects of interest 202 are detected by analyzing the optimized signals.

In the fifth step 304, the controller 183 makes a sorting decision based upon the signals and the applied compensation resulting from the prior optimizing.

In the sixth step 305, individual objects of interest 202 that have undesirable characteristics 209 are removed from the product stream 201 by the ejector apparatus 203.

The laser scanner 20 detects the interference because it has an aperture (not shown) that is larger than the size of the laser beam spot. The detector aperture is scanned coincident with the laser beam spot by a spinning polygon mirror 232. (FIG. 14). Since the coincident laser scanner detector aperture is larger than the scanned laser beam spot, the detection aperture will receive selected interference from a non-scanned illumination source reflection 30, which extends spatially across the scanner line of sight (LOS) and is not scanned like the laser beam spot. Because the detection aperture can sense selected interference, essentially all around, the laser beam spot, if there is significant interaction with the object of interest 202 by the selected interference, then there will be a "halo" of interference signal around the object of interest's image. This "halo" is useful because the "halo" indicates how each object of interest 202 interacts with the selected interference. If the object of interest 202 does not interact with the selected interference, then there will be no "halo". If the object of interest 202 exhibits a significant interaction with the selected interference, any resulting "halo" can be used as an indicator of this effect. So, in addition to pre-determined/pre-calculated interference responses measured during system setup, the instant improved method and apparatus can also measure some indication of the selected interference effects during runtime as part of real-time sorting.

It is recognized that compensation may not fully "cancel out" the interference/noise but can substantially reduce the undesirable effects of the interference such that the desirable effects (longer exposure duration, increased signal amplitude, greater signal-to-noise ratio-particularly for otherwise weak signals like polarization responses) endure and thereby provide an overall net improvement in the contrast and therefore the sorting.

The instant improved invention adds a known noise/interference to a chosen electromagnetic radiation detection device 11, 20 to improve the response of a related additional detection device 11, 20, and then the invention compensates for the selected addition of the known noise/interference to recover the first detector signal. Dither may also be added to the interrogation signals 187 by the controller 183 to improve a portion of interrogation signals 187.

The improvement set forth herein allows the respective electromagnetic radiation detection devices 11, 20 to be operated over a longer period of time and therefore collect additional energy/light/signal. The collection of the additional energy/light/signal allows improved overall discrimination of unacceptable features.

Operation

The operation of the described embodiments of the present invention are believed to be readily apparent and are briefly summarized at this point. In its broadest aspect, the methodology of the present invention includes the steps of providing a stream 202 of individual products 201 to be sorted, and wherein the individual products 201 have a multitude external and internal of characteristics that are perceptible. The methodology of the present invention includes a second step of moving the stream of individual products 201 through an inspection station 33. Still another step of the present invention includes providing a plurality of electromagnetic radiation detection devices 11 and 20, respectively, in the inspection station 33 for identifying the multitude of external and internal features and characteristics of the individual products. The respective electromagnetic radiation detection devices 11, 20, when actuated, generate device signals 187, and wherein at least some of the plurality of electromagnetic radiation detection devices 11 and 20, when actuated, interfere in the operation of other actuated electromagnetic radiation detection devices. The methodology includes another step of providing a controller 183 for selectively actuating the respective electromagnetic radiation detection devices 11, 20 and emitters/illuminators 30, 40 respectively, in a coordinated pre-determined order, and in real-time, to create the known interference. The methodology includes another step of determining a compensation caused by the known interference and applying the compensation to the interrogation signals 187 so as to optimize the interrogation signals. The methodology includes another step of delivering the electromagnetic radiation detection device signals 187 which are generated by the respective electromagnetic radiation detection devices, to the controller 183. In the methodology of the present invention, the method includes another step of forming a real-time multiple-aspect representation of the individual products 201, and which are passing through the inspection station 33, with the controller 183, by utilizing the respective electromagnetic radiation detection device signals 187, and which are generated by the electromagnetic radiation detection devices 11, 20. The multiple-aspect representation has a plurality of features formed from the external and internal characteristics detected by the respective electromagnetic radiation detection devices 11, 20 and 30, respectively. The method includes still another step of sorting the individual products 201 based, at least in part, upon the multiple aspect representation formed by the controller, in real-time, as the individual objects 201 pass through the inspection station 33.

It should be understood that the multitude of external and internal characteristics and features of the individual products 201, in the product stream 202 are selected from the group comprising, but not limited to, color; light polarization; fluorescence; surface texture; light absorbance, light transmittance and translucence to name but a few. It should be understood that the step of moving the stream of products 201 through the inspection station 33 further comprises releasing the stream of products 202, in one form of the invention, for unsupported downwardly directed, gravity influenced, movement through the inspection station 33, and positioning the plurality of electromagnetic radiation detection devices 11, 20 on opposite sides 51, and 52, of the unsupported stream of products 202. It is possible to also use the invention 10 to inspect products on a continuously moving conveyor belt 200, or on a downwardly declining chute (not shown). In the methodology as described above, the step of providing a plurality of electromagnetic radiation detection and emitting devices 11, 20, 30 and 40, respectively, in the inspection station 33, further comprises selectively actuating the respective electromagnetic radiation detection devices 11, 20, in real-time, so as to enhance the operation of the respective electromagnetic radiation detection and emitting devices. Still further, the step of providing a plurality of electromagnetic radiation detection and emitting devices 11, 20, 30 and 40, respectively, in the inspection station 33, further comprises selectively combining the respective electromagnetic radiation detection device signals 187 of the individual electromagnetic radiation detection devices to provide an increased contrast in the external and internal characteristics and features identified on/in the individual products 201, and which are passing through the inspection station 33. It should be understood that the step of generating a electromagnetic radiation detection device signal 187 by the plurality of electromagnetic radiation detection devices in the inspection station further includes identifying a gradient of the respective external and internal characteristics and features which are possessed by the individual products 201, which are passing through the inspection station 33.

In the methodology as described, above, the step of providing a plurality of electromagnetic radiation detection devices further comprises providing a plurality of selectively energizable electromagnetic radiation emitter illuminators 30, which emit, when energized, electromagnetic radiation 31, which is directed towards, and reflected from, refracted by, transmitted by or absorbed by individual products 201, and which are passing through the inspection station 33. The methodology further includes a step of providing a plurality of selectively operable electromagnetic radiation detector devices or image capturing devices 11, 20 and which are oriented so as to receive the reflected, refracted, transmitted electromagnetic radiation 31 from the individual products 201, and which are passing through the inspection station 33. The present method also includes another step of controllably coupling the controller 183 to each of the selectively energizable electromagnetic radiation emitter illuminators 30, and the selectively operable electromagnetic radiation detector image capturing devices 11, 20. In the arrangement as provided, and as discussed above, the selectively operable electromagnetic radiation detector image capturing devices are selected from the group comprising, but not limited to, cameras, laser scanners; line scanners; and the electromagnetic radiation detector image capturing devices are oriented in different, perspectives, and orientations relative to the inspection station 33. The respective electromagnetic radiation detector image capturing devices are oriented so as to provide device signals 187 to the controller 183, and which would permit the controller 183 to generate a multiple aspect representation of the individual products 201 passing through the inspection station 33, and which have increased individual feature discrimination.

As should be understood, the selectively energizable electromagnetic radiation emitter illuminators 30 emit electromagnetic radiation, which is selected from the group comprising visible; invisible; collimated; non-collimated; focused; non-focused; pulsed; non-pulsed; phase-synchronized; non-phase-synchronized; polarized; and non-polarized electromagnetic radiation and to further the emitted electromagnetic radiation can be of various wavelengths and various predetermined wavelength bands/spectrums so as to interact with various external and internal characteristics and features of the individual objects.

The method as described and discussed further includes a step of providing and electrically coupling an image preprocessor 184 with a controller 183. Before the step of delivering the device signals 187, which are generated by the respective electromagnetic radiation detection and emitting devices 11, 20, 30 and 40 to the controller 183, the methodology includes a step of delivering the electromagnetic radiation detection device signals 187 to the image preprocessor 184. Further, the step of delivering the device signal 187 to the image preprocessor further comprises, combining and correlating phase-specific and synchronized electromagnetic radiation detection device signals 187, by way of a sub-pixel digital alignment in a scaling and a correction of generated electromagnetic radiation detection device signals 187, which are received from the respective electromagnetic radiation detection and emitting devices 11, 20, 30 and 40, respectively.

The Method and Apparatus for Sorting as set forth and described with particularity herein has been materially improved.

The method of sorting, of the present invention, includes, in one possible form, a step of providing a source of products 201 to be sorted, and secondly, providing a conveyor 200 for moving the source of products 202 along the path of travel, and then releasing the products 201 to be sorted into a product stream 202 for unsupported gravity influenced movement through a downstream inspection station 33. In this particular form of the invention, the methodology includes another step of providing a first, selectively energizable electromagnetic radiation emitter illuminator 30, which is positioned elevationally above, or to the side of the product stream 202, and which, when energized, generates electromagnetic radiation waves 31 directed toward the product stream 202 which is moving through the inspection station 33. The methodology includes another step of providing a first, selectively operable electromagnetic radiation detector image capturing device 11, and which is operably associated with the first electromagnetic radiation emitter illuminator 30, and which is further positioned elevationally above, or to the side of the product stream 202, and which, when actuated, captures images of the illuminated product stream 202, moving through the inspection station 33. The method, as described herein, includes another step of providing a second selectively energizable electromagnetic radiation emitter illuminator 30, which is positioned elevationally below, or to the side of the product stream 202, and which, when energized, emits a narrow beam of electromagnetic radiation (light) 31, which is scanned along a path of travel, and across the product stream 202, which is moving through the inspection station 33. The method includes yet another step of providing a second, selectively operable electromagnetic radiation detection image capturing device 20, which is operably associated with the second electromagnetic radiation emitter illuminator 30, and which is further positioned elevationally above, or to the side of the product stream, and which, when actuated, captures images of the product stream 202, and which is illuminated by the narrow beam of light 31, and which is emitted by the second selectively energizable electromagnetic radiation emitter illuminator 30. The methodology includes another step of providing a third, selectively energizable electromagnetic radiation emitter illuminator 30, which is positioned elevationally below, or to the side of the product stream 202, and which, when energized, generates electromagnetic radiation waves 31 directed toward the product stream 202, and which is moving through the inspection station 33. In the methodology as described, the method includes another step of providing a third, selectively operable electromagnetic radiation detection image capturing device 11, and which is operably associated with the second electromagnetic radiation emitter illuminator 30, and which is further positioned elevationally below, or to the side of the product stream 202, and which further, when actuated, captures images of the illuminated product stream 202, moving through the inspection of station 33; and generating with the first, second and third electromagnetic radiation detection image capturing devices 11, an image signal 187, formed of the signals generated by the first, second and third electromagnetic radiation detection imaging capturing devices. The methodology includes another step of providing a controller 183, and electrically coupling the controller 183 in controlling relation relative to each of the first, second and third electromagnetic radiation emitter illuminators 30, and electromagnetic radiation detection image capturing devices 11, respectively, and wherein the controller 183 is operable to individually and sequentially energize, and then render operable the respective first, second and third electromagnetic radiation emitter illuminators 30, and associated electromagnetic radiation detection image capturing devices 11 in a predetermined pattern, so that only one electromagnetic radiation emitter illuminator 30, and the associated electromagnetic radiation detection image capturing device 11, is energized or rendered operable during a given time period. The controller 183 further receives the respective image signals 187, which are generated by each of the first, second and third electromagnetic radiation detection image capturing devices 11, and which depict the product stream 202 passing through the inspection station 33, in real-time. The controller 183 analyzes the respective image signals 187 of the first, second and third electromagnetic radiation detection image capturing devices 11, and identifies any unacceptable products 201 which are moving along in the product stream 202. The controller 183 generates a product ejection signal 204, which is supplied to an ejection station 203 (FIG. 9), and which is downstream of the inspection station 33.

In the method as described in the paragraph immediately above, the methodology includes another step of aligning the respective first and third electromagnetic radiation emitter illuminators 30, and associated electromagnetic radiation detection image capturing devices 11, with each other, and locating the first and third electromagnetic radiation emitter illuminators 30 on opposite sides 51, and 52 of the product stream 202. In the methodology of the present invention, the predetermined coordinated pattern of energizing the respective electromagnetic radiation emitter illuminators 30, and forming an image signal 187, with the associated electromagnetic radiation detection image capturing devices 11, further comprises the steps of first rendering operable the first electromagnetic radiation emitter illuminator 30, and associated electromagnetic radiation detection image capturing device 11 for a first pre-determined period of time; second rendering operable the second electromagnetic radiation emitter illuminator, and associated electromagnetic radiation detection image capturing device for a second predetermined period of time, and third rendering operable the third electromagnetic radiation emitter illuminator 30 and associated electromagnetic radiation detection image capturing device 11 for a third pre-determined period of time. In this arrangement, the predetermined time periods may partially or fully overlap. In the arrangement as provided, the step of energizing the respective electromagnetic radiation emitter illuminators 30 in a pre-determined pattern and electromagnetic radiation detection image capturing devices takes place in a time interval of about 50 microseconds to about 500 microseconds. As should be understood, the first predetermined time period is about 25 microseconds to about 250 microseconds; the second predetermined time period is about 25 microseconds to about 150 microseconds, and the third predetermined time period is about 25 microseconds to about 250 microseconds. In the methodology as described, the first and third electromagnetic radiation emitter illuminators comprise pulsed light emitting diodes; and the second electromagnetic radiation emitter illuminator comprises a laser scanner. Still further, it should be understood that the respective electromagnetic radiation emitter illuminators, when energized, emit electromagnetic radiation which lies in a range of about 400 nanometers to about 1,600 nanometers. It should be understood that the step of providing the conveyor 200 for moving the product 201 along a path of travel comprises providing a continuous belt conveyor, having an upper and a lower flight, and wherein the upper flight has a first intake end, and a second exhaust end, and positioning the first intake end elevationally above the second exhaust end. In the methodology of the prevent invention, the step of transporting the product with a conveyor 200 takes place at a predetermined speed of about 3 meters per second to about 5 meters per second. In one form of the invention, the product stream 202 moves along a predetermined trajectory, which is influenced, at least in part, by gravity, and which further acts upon the unsupported product stream 202. In at least one form of the present invention, the product ejection station 203 is positioned about 50 millimeters to about 150 millimeters downstream of the inspection station 33.

The present invention discloses a method for sorting a product 10 which includes a first step of providing a source of a product 201 to be sorted; and a second step of transporting the source of the product along a predetermined path of travel, and releasing the source of product into a product stream 202 which moves in an unsupported gravity influenced free-fall trajectory along at least a portion of its path of travel. The method includes another step of providing an inspection station 33 which is located along the trajectory of the product stream 202; and a step of providing a first selectively energizable electromagnetic radiation emitter illuminator 30, and locating the first electromagnetic radiation emitter illuminator 30 to a first side of the product stream 202, and in the inspection station 33. The methodology of the present invention includes another step of providing a first, selectively operable electromagnetic radiation detection image capturing device 11, and locating the first electromagnetic radiation detection image capturing device 11 to the first side of the product stream 202. The present methodology includes another step of selectively energizing the first electromagnetic radiation emitter illuminator 30, and rendering the first electromagnetic radiation detection image capturing device 11 operable, substantially simultaneously, for a first predetermined time period, so as to illuminate/irradiate the product stream 202, moving through the inspection station 33, and subsequently generate an image signal 187, with the first electromagnetic radiation detection image capturing device 11 of the illuminated/irradiated product stream 202. The present methodology 10 includes another step of providing a second, selectively energizable electromagnetic radiation emitter illuminator 30, and locating the second electromagnetic radiation emitter illuminator 30 on a first side of the product stream 202, and in spaced relation relative to the first electromagnetic radiation emitter illuminator 30. The method includes another step of providing a second, selectively operable electromagnetic radiation detection image capturing device 20, and locating the second electromagnetic radiation detection image capturing device 20 on the first side of the product stream 202. The method includes another step of selectively energizing the second electromagnetic radiation emitter illuminator so as to generate a narrow beam of electromagnetic radiation or light, which is scanned across a path of travel which is transverse to the product stream 202, and which further is moving through the inspection station 33. The method, as described further, includes a step of rendering the second electromagnetic radiation detection image capturing device 20 operable substantially simultaneously, for a second predetermined time period that may at least partially overlap the first predetermined time period. The second electromagnetic radiation emitter illuminator illuminates/irradiates, with a narrow beam of electromagnetic radiation (light), the product stream 202, which is moving through the inspection station 33; and the second electromagnetic radiation detection image capturing device 20 generates an image signal 187 of the illuminated/irradiated product stream 202. The method includes another step of providing a third, selectively energizable electromagnetic radiation emitter illuminator 30, which is positioned to a second side of the product stream 202, and which, when energized, illuminates/irradiates the product stream 202 moving through the inspection station 33. The method includes still another step of providing a third, selectively operable electromagnetic radiation detection image capturing device 11, and locating the third electromagnetic radiation detection image capturing device 11 to the second side of the product stream 202. In the methodology as described, another step includes selectively energizing the third electromagnetic radiation emitter illuminator 30, and rendering the third electromagnetic radiation detection image capturing device 11 operable substantially simultaneously for a third predetermined time period, so as to illuminate/irradiate the product stream 202 moving through the inspection station 33, while substantially simultaneously forming an image signal 187 with a third electromagnetic radiation detection image capturing device 11 of the illuminated product stream 202. The present methodology 10 includes another step of providing a fourth, selectively energizable electromagnetic radiation emitter illuminator, and locating the fourth electromagnetic radiation emitter illuminator to the second side of the product stream 202. The method includes another step of providing a fourth, selectively operable electromagnetic radiation detection image capturing device 20, and locating the fourth electromagnetic radiation detection image capturing device 20 on the second side of the product stream 202. The method includes another step of selectively energizing the fourth electromagnetic radiation emitter illuminator so as to generate a narrow beam of electromagnetic radiation or light, which is scanned across a path of travel which is transverse to the product stream 202, and which further is moving through the inspection station 33. The method, as described further, includes a step of rendering the fourth electromagnetic radiation detection image capturing device 20 operable substantially simultaneously, for a fourth predetermined time period. The fourth electromagnetic radiation emitter illuminator illuminates/irradiates, with a narrow beam of electromagnetic radiation (light), the product stream 202, which is moving through the inspection station 33; and the fourth electromagnetic radiation detection image capturing device 20 generates an image signal 187 of the illuminated/irradiated product stream 202. The method as described includes another step of providing a controller 183, and coupling the controller 183 in controlling relation relative to each of the first, second and third electromagnetic radiation detection image capturing devices 11, 20 and electromagnetic radiation emitter illuminators 30, respectively. The methodology includes another step of providing and electrically coupling an image preprocessor 184, with the controller 183, and supplying the image signals 187 which are formed by the respective first, second and third electromagnetic radiation detection image capturing devices 11, 20, to the image preprocessor 184. The methodology includes another step of processing the interrogation signals 187, which are received by the image preprocessor 184, and supplying the interrogation signals to the controller 183, so as to subsequently identify a defective product or a product having a predetermined undesirable characteristics/feature which may be external or internal, in the product stream 202, and which is passing through the inspection station 33. The controller 183 generates a product ejection signal when the defective product and/or product having a given characteristic/feature, is identified. The method includes another step of providing a product ejector 203, which is located downstream of the inspection station 33, and along the trajectory or path of travel of the product stream 202, and wherein the controller 183 supplies the product ejection signal 204 to the product ejector 203 to effect the removal of the identified defective product or product having a predetermined feature from the product stream.

The present invention 10 can be further described according to the following methodology. A method for sorting products 10 is described, and which includes the steps of providing a nominally continuous stream of individual products 201 in a flow of bulk particulate, and in which individual products 201 have multiple distinguishing features and characteristics, and where some of these features may be hidden or internal so as to not be easily discerned visually, in real-time. The methodology includes another step of distributing the stream of products 202, in a mono-layer of bulk particulate, and conveying or directing the products 201 through one or more automated inspection stations 33, and one or more automated ejection stations 203. The methodology includes another step of providing a plurality of electromagnetic radiation emitters/illuminators 30, and electromagnetic radiation detection devices 11, 20, in the inspection station 33, and wherein the electromagnetic radiation emitters/illuminators and electromagnetic radiation detection devices use multiple modes of non-contact, non-destructive interrogation to identify distinguishing features and characteristics of the products 201, and wherein some of the multiple modes of non-contact, non-destructive product interrogation, if operated continuously, simultaneously and/or coincidently, intentionally interfere with at least some of the interrogation result signals 187, and which are generated for the respective objects of interest 201, and which are passing through the inspection station 33. The methodology includes another step of providing a configurable, programmable, multi-phased, synchronizing interrogation signal acquisition controller 183, and an integrated interrogation signal data pre-processor 184, which is operably coupled to the electromagnetic radiation emitter illumination and electromagnetic radiation detection devices 30, 20 and 11, respectively, to selectively activate the individual electromagnetic radiation emitter illuminators, and electromagnetic radiation detectors in a programmable, pre-determined order specific to the individual products 201 being inspected to preserve spatially correlated and pixilated real-time interrogation signal data 187, from each actuated detector 11 and 20, respectively, to the controller 183, as the products 201 pass through the inspection station 33.

The methodology includes another step of providing sub-pixel level correction of spatially correlated, pixilated interrogation signal 187, from each selectively actuated electromagnetic radiation detection device 11, 20, to form multi-modal, multi-dimensional, digital images representing the product flow 202, and wherein the multiple dimensions of digital data 187 indicate distinguishing features and characteristics of the individual objects of interest 201. The method includes another step of providing a configurable, programmable, real-time, multi-dimension interrogation signal data processor 182, which is operably coupled to the controller 183, and preprocessor 184, to identify products 201, and product features/characteristics possessed by the individual products from contrast gradients and predetermined ranges, and patterns of values specific to the individual products 201, from the preprocessed continuous interrogation signal data 187. The method 10 includes another step of providing one or more spatially and temporally targeted ejection devices 203, which are operably coupled to the controller 183, and preprocessor 184, to selectively re-direct selected objects or products 201 within the stream of products 202, as they individually pass through the ejection station 203.

Referring now to FIG. 1E, the first embodiment of the invention 10 is depicted, and is illustrated in one form. While simple in its overall arrangement, this first embodiment supports scan rates between the electromagnetic radiation detection device, shown as a camera 11, and the electromagnetic radiation detection device, shown as a laser scanner 20, of 2:1, and wherein the electromagnetic radiation detection device camera 11 can run twice the scan rate of the electromagnetic radiation detection device laser scanner 20. This is a significant feature because electromagnetic radiation detection device laser scanners are scan-rate limited by inertial forces due to the size and mass of the associated polygonal mirror used to direct a flying scan spot formed of electromagnetic radiation, to the inspection station 33. On the other hand, the camera 11 has no moving parts, and are scan-rate limited solely by the speed of the electronics and the amount of exposure that can be generated per unit of time that they are energized or actuated.

Referring now to FIG. 2, a second embodiment of the invention is shown, and which adds a second, opposite side electromagnetic radiation detection camera 55, which uses the time slot allotted to the first electromagnetic radiation detection camera's second exposure. This arrangement as seen in FIG. 2, is limited to 1:1 scan rates.

Referring now to FIG. 3, the third embodiment of the invention adds a second electromagnetic radiation detection laser scanner 20, which is phase-delayed from the first electromagnetic radiation detection scanner, to avoid having their respective scanned spots formed of electromagnetic radiation from being in the same place at the same time. This form of the invention has the 1:1 scan rate.

Referring now to FIG. 4, a fourth embodiment of the invention is shown and which divides the time slot allotted for each electromagnetic radiation detection camera 111*a* and 112*a*, respectively, into two time slots, when compared to the previous two embodiments, so that both cameras 11 can run at twice the scan rate of the associated electromagnetic radiation detection laser scanner 20. The associated detector hardware configuration is the same as the second form of the invention, but control and exposure timing are different, and can be selectively changed by way of software commands such that a user (not shown) can select sorting and actuation patterns that use one mode, or the other, as appropriate for a particular sorting application.

Referring now to FIG. 5, a fifth form of the invention is illustrated and wherein a second electromagnetic radiation detection laser scanner 132*b* is provided, and which includes the scanning timing as seen in the fourth form of the invention. As noted above, the associated detector hardware configuration is the same as the third form of the invention, but control and exposure timing are different, and can be changed such that a user could select sorting steps that use only one mode or the other, as appropriate, for a particular sorting application.

Referring now to FIG. 6, the sixth form of the invention introduces a dual electromagnetic radiation detection camera arrangement 151 and 152, respectively, and wherein the electromagnetic radiation detection cameras view active backgrounds that are also foreground illumination for the opposite side electromagnetic radiation detection camera. Each electromagnetic radiation detection camera acquires both reflective and transmitted images which create another form of the multi-modal, multi-dimensional image. In this embodiment, each electromagnetic radiation detection camera scans at twice the overall system scan rate, but interrogation signal data 187 is all at the overall system scan rate, since half of each of the electromagnetic radiation detection camera's exposure is for a different imaging mode prior to pixel data fusion, which then produces higher dimensional, multi-modal images at the system scan rate, which is provided.

Referring now to FIG. 7, this form of the invention adds a dual-mode reflection/transmission electromagnetic radiation detection camera operation embodiment of the sixth form of the invention with an electromagnetic radiation detection laser scanner 161B which is similar to the second and fourth embodiments. A difference in this arrangement is that either selectively active backgrounds are used in a detector arrangement as shown in FIG. 2 or 4, or electromagnetic radiation detection cameras are aimed at opposite side electromagnetic radiation emitter illuminators, as seen in FIG. 7. Using the detector arrangement, as shown in the second form of the invention, provides more flexibility but requires more hardware.

Referring now to FIG. 8, this form of the invention adds a second electromagnetic radiation detection laser scanner 172*b* to that seen in the seventh form of the invention, and further employs the time-phased approach as seen in the third and fifth forms of the invention. As should be understood, the present invention can be scaled to increase the number of electromagnetic radiation detection detectors and electromagnetic radiation emitters/illuminators.

The instant invention provides a method of sorting comprising providing a source of a product to be sorted, which includes of a plurality of individual items each having a multitude of internal and external characteristics, and wherein the multitude of internal and external characteristics are selected from a group including color; light polarization; light fluorescence; light reflectance; light scatter, light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items; conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items; providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station; providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation generates an interrogation signal, and wherein the plurality of selectively energizable illumination devices, if energized simultaneously, emit electromagnetic radiation which interferes in the operation of at least one of the plurality of selectively actuated electromagnetic radiation detection devices, and enhances a contrast, as the individual items pass through the inspection station.

The instant method for sorting further comprises the step of providing a controller for selectively energizing the plurality of illumination sources in a predetermined order, and for predetermined durations of time, and in predetermined wavelength spectrums, and in real time, so that the selectively actuated electromagnetic radiation detection devices receive the selective electromagnetic radiation and responsively generate the interrogation signals.

The instant method for sorting further comprises the step of acquiring, and communicating, the interrogation signals from the plurality of selectively actuated electromagnetic radiation detection devices to the controller.

The instant method for sorting further comprises the step of analyzing, with the controller, the acquired interrogation signals and identifying the interferences within the respective interrogation signals.

The instant method for sorting further comprises the step of optimizing, with the controller, the interference, to increase the contrast between the multitude of characteristics of the individual items.

The instant method for sorting further comprises the step of detecting and identifying the multitude of characteristics of the individual items passing through the inspection station by forming a real-time, multiple-aspect representation of the individual items with the controller by utilizing the increased contrast provided by the optimized interferences.

The instant method for sorting further comprises the step of sorting the individual objects passing through the inspection station based, at least in part, upon the multiple aspect representation formed by the controller, as the individual objects pass through the inspection station.

The instant method for sorting further comprises the step of providing a background in the inspection station and aligning the background along the single focal plane and wherein the background, when selectively energized by the controller, emits electromagnetic radiation for predetermined durations of time and in predetermined wavelength spectrums, so that the selectively actuated electromagnetic radiation detection devices receive the electromagnetic radiation from the selectively energized background, and the electromagnetic radiation from the selectively energized background corresponds to the interference.

The instant method for sorting further comprises the step of selectively energizing the background for the predetermined durations of time partially temporally overlaps the selective energizing of at least one illumination source and the selective actuation of at least one electromagnetic radiation detection device.

The instant method for sorting further comprises the step of selectively energizing the background for the predetermined durations of time completely temporally overlaps the selective energizing of at least one illumination source and the selective actuation of at least one electromagnetic radiation detection device.

The instant method for sorting further comprises the step of selectively energizing the background for the predetermined durations of time does not temporally overlap the selective energizing of at least one illumination source and the selective actuation of at least one electromagnetic radiation detection device.

The instant method for sorting further comprises the step of selectively energizing multiple foreground illumination sources for the predetermined durations of time partially temporally overlaps the selective energizing of at least one illumination source and the selective actuation of at least one electromagnetic radiation detection device.

The instant method for sorting further comprises the step of selectively energizing multiple foreground illumination sources for the predetermined durations of time completely temporally overlaps the selective energizing of at least one illumination source and the selective actuation of at least one electromagnetic radiation detection device.

The instant method for sorting further comprises the step of selectively energizing multiple foreground illumination sources for the predetermined durations of time does not temporally overlap the selective energizing of at least one illumination source and the selective actuation of at least one electromagnetic radiation detection device.

The instant method for sorting further comprises the step of selectively energizing multiple foreground illumination sources for the predetermined durations of time which partially temporally overlap the selective energizing of the background.

The instant method for sorting further comprises the step of selectively energizing multiple foreground illumination sources for the predetermined durations of time which completely temporally overlap the selective energizing of the background.

The instant method for sorting further comprises the step of selectively energizing multiple foreground illumination sources for the predetermined durations of time which do not temporally overlap the selective energizing of the background.

The instant method for sorting further comprises the step of determining a compensation that optimizes the interference and applying the determined compensation to the interference, by means of the controller, to address the interference; and making a sorting decision based upon the interrogation signal less the known interference.

The instant method for sorting further comprises the step wherein the predetermined duration of time of energizing at least one selectively energizable illumination source temporally exceeds the predetermined duration of time of actuation of a corresponding selectively actuated electromagnetic radiation detection device so that the illumination provided by the energized illumination source is detected and received by plural electromagnetic radiation detection devices.

The instant method for sorting further comprises the step wherein the interference allows an increase in interrogation signal amplitude.

The instant method for sorting further comprises the step wherein the emitted electromagnetic radiation is synchronous.

The instant method for sorting further comprises the step wherein the emitted electromagnetic radiation is phase-aligned.

The instant method for sorting further comprises the step wherein the emitted electromagnetic radiation is collimated.

The instant method for sorting further comprises the step wherein the emitted electromagnetic radiation is polarized.

The instant method for sorting further comprises the step wherein the emitted electromagnetic radiation is diffused.

The instant method for sorting further comprises the step wherein the emitted electromagnetic radiation is multi-directional.

The instant method for sorting further comprises the step wherein the electromagnetic radiation is transmitted through the objects of interest and the selectively actuated electromagnetic radiation detectors receive the transmitted electromagnetic radiation; and the interrogation signal generated by the selectively actuated electromagnetic radiation detector is formed from received transmitted electromagnetic radiation.

The instant method for sorting further comprises the step wherein contrast within the interrogation signal generated by the electromagnetic radiation detectors is improved by detecting a polarization response.

The instant method for sorting further comprises the step wherein the electromagnetic radiation is reflected by the objects of interest and the electromagnetic radiation detectors receive the reflected electromagnetic radiation; and the interrogation signals generated by the electromagnetic radiation detectors is formed from received reflected electromagnetic radiation.

The instant method for sorting further comprises the step wherein contrast within the interrogation signal generated by the electromagnetic radiation detectors is improved by detecting a polarization response.

The instant method for sorting further comprises the step of initiating a predetermined synchronous phase aligned interference between selectively energized illumination sources and the selectively actuated electromagnetic radiation detection devices.

The instant method for sorting further comprises the step optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

The instant method for sorting further comprises providing a source of a product to be sorted, which includes of a plurality of individual items each having a multitude of internal and external characteristics, and wherein the multitude of internal and external characteristics are selected from a group including color; light polarization; light fluorescence; light reflectance; light scatter; light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items; conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items; providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station; providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation, generates an interrogation signal, and wherein the plurality of selectively energizable illumination devices, if energized simultaneously, emit electromagnetic radiation which interferes in the operation of at least one of the plurality of selectively actuated electromagnetic radiation detection devices, and enhances a contrast as the individual items pass through the inspection station; providing a controller for selectively energizing the plurality of selectively energizable illumination sources in a predetermined order, and for predetermined durations of time, and in predetermined wavelength spectrums, and in real time, so that the selectively actuated electromagnetic radiation detection devices receive the electromagnetic radiation and responsively generate the interrogation signals; acquiring, and communicating, the interrogation signals from the plurality of selectively actuated electromagnetic radiation detection devices to the controller; analyzing, with the controller, the acquired interrogation signals and identifying the interference within the respective interrogation signals; optimizing, with the controller, the interference, to increase the contrast between the multitude of internal and external characteristics of the individual items; detecting and identifying the multitude of internal and external characteristics of the individual items passing through the inspection station by forming a real-time, multiple-aspect representation of the individual items with the controller by utilizing the increased contrast provided by the optimized interference; and sorting the individual items passing through the inspection station based, at least in part, upon the multiple aspect representation formed by the controller, as the individual items pass through the inspection station.

The instant method for sorting further comprises the step wherein|[JT4] the contrast within the interrogation signal generated by the selectively actuated electromagnetic radiation detection device is improved by detecting a polarization response.

The instant method for sorting further comprises the step providing a background in the inspection station and aligning the background along the single focal plane and wherein the background, when selectively energized by the controller, emits electromagnetic radiation for predetermined durations of time and in predetermined wavelength spectrums, so that the selectively actuated electromagnetic radiation detection devices receive the electromagnetic radiation from the selectively energized background, and the electromagnetic radiation from the selectively energized background corresponds to the interference.

The instant method for sorting further comprises providing multiple foreground illumination sources, and wherein the selective energizing of the multiple foreground illumination sources for the predetermined durations of time partially temporally overlaps the selective energizing of at least one illumination source and the selective actuation of at least one electromagnetic radiation detection device.

The instant method for sorting further comprises providing multiple foreground illumination sources, and wherein the selective energizing of the multiple foreground illumination sources for the predetermined durations of time completely temporally overlaps the selective energizing of at least one illumination source and the selective actuation of at least one electromagnetic radiation detection device.

The instant method for sorting further comprises the step determining a compensation that optimizes the interference and applying the determined compensation to the interference, by means of the controller, to address the interference; and making a sorting decision based upon the interrogation signal less the known interference.

The instant method for sorting further comprises the step wherein the interference allows an increase in interrogation signal amplitude.

The instant method for sorting further comprises the step wherein the emitted electromagnetic radiation is synchronous.

The instant method for sorting further comprises the step wherein the emitted electromagnetic radiation is phase-aligned.

The instant method for sorting further comprises the step wherein the emitted electromagnetic radiation is collimated.

The instant method for sorting further comprises the step wherein the emitted electromagnetic radiation is polarized.

The instant method for sorting further comprises the step wherein the emitted electromagnetic radiation is diffused.

The instant method for sorting further comprises the step wherein the emitted electromagnetic radiation is multi-directional.

The instant method for sorting further comprises the step wherein the electromagnetic radiation is transmitted through the objects of interest and the selectively actuated electromagnetic radiation detectors receive the transmitted electromagnetic radiation; and the interrogation signal generated by the selectively actuated electromagnetic radiation detector is formed from received transmitted electromagnetic radiation.

The instant method for sorting further comprises the step wherein contrast within the interrogation signal generated by the electromagnetic radiation detectors is improved by detecting a polarization response.

The instant method for sorting further comprises the step wherein the electromagnetic radiation is reflected by the objects of interest and the electromagnetic radiation detectors receive the reflected electromagnetic radiation; and the interrogation signals generated by the electromagnetic radiation detectors is formed from received reflected electromagnetic radiation.

The instant method for sorting further comprises the step wherein contrast within the interrogation signal generated by the electromagnetic radiation detectors is improved by detecting a polarization response.

The instant method for sorting further comprises the step initiating a predetermined synchronous phase aligned interference between selectively energized illumination sources and the selectively actuated electromagnetic radiation detection devices.

The instant method for sorting further comprises the step optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

The instant invention further provides sorting apparatus comprising a source of individual products to be sorted; a conveyor for moving the individual products along a given path of travel, and into an inspection station; a plurality of selectively energizable illuminators located in different, spaced, angular orientations relative to the inspection station, and which, when energized, individually emit electromagnetic radiation which is directed towards, and reflected from or transmitted by, the respective products passing through the inspection station; a plurality of selectively operable image capturing devices which are located in different, spaced, angular orientations relative to the inspection station, and which, when rendered operable, captures the electromagnetic radiation reflected from or transmitted by the individual products passing through the inspection station, and forms an image of the electromagnetic radiation which is captured, and wherein the respective image capturing devices each form an image signal; a controller coupled in controlling relation relative to each of the plurality of illuminators and image capturing devices, and wherein the image signal of each of the image capturing device is delivered to the controller, and wherein the controller selectively energizes individual illuminators, and image capturing devices in a predetermined sequence so as generate multiple image signals which are received by the controller, and which are combined into a multiple aspect image, in real-time, and which has a multiple of characteristics and gradients of the measured characteristics, and wherein the multiple aspect image which is formed allows the controller to identify individual products in the inspection station having a predetermined feature; and a product ejector coupled to the controller and which, when actuated by the controller, removes individual products from the inspection station having features identified by the controller from the multiple aspect image.

The instant invention still further provides a sorting apparatus further comprising a plurality of selectively energizable illuminators, which when energized, emit visible, and invisible bands of electromagnetic radiation.

The instant invention still further provides a sorting apparatus wherein the selectively energizable illuminators are located on opposite sides of the path of travel of the individual products as they individually move through the inspection station, and wherein the respective, selectively energizable illuminators each have a primary axis of illumination which intersects along a line of reference which is located in the inspection station, and through which the individual products pass.

The instant invention still further provides a sorting apparatus wherein the controller selectively energizes individual illuminators and image capturing devices in a predetermined sequence that at least partially overlap one another to generate an intentional interference.

The instant invention still further provides a sorting apparatus wherein the controller selectively energizes individual illuminators and image capturing devices in a predetermined sequence that completely overlap one another to generate an intentional interference.

The instant invention still further provides a sorting apparatus wherein the resulting multiple aspect images formed by the controller include feature contrasts which include gradients comprised of differences in image signal amplitudes within an aspect and differences between amplitudes of different aspects to enhance the discrimination or identification of features of interest within the multiple aspect images.

The instant invention still further provides a sorting apparatus wherein the resulting multiple aspect images formed by the controller include feature contrasts which include gradients comprised of differences in image signal amplitudes within an aspect and differences between amplitudes of different aspects to enhance the discrimination or identification of features of interest within the multiple aspect images.

Therefore, it will be seen that the present invention provides a convenient means whereby the interference that results from the operation of multiple detectors and illuminators is optimized to provide enhanced contrast and enhanced interrogation signals, and simultaneously provides a means for collecting multiple levels of data, which can then be assembled, in real-time, to provide a means for providing intelligent sorting decisions in a manner not possible heretofore.

In compliance with the statute, the invention has been described in language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

The invention claimed is:

1. A method of sorting comprising:

providing a source of a product to be sorted, which includes of a plurality of individual items each having a multitude of internal and external characteristics, and wherein the multitude of internal and external characteristics are selected from a group including color; light polarization; light fluorescence; light reflectance; light scatter; light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items;

conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items;

providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station;

providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation generates an interrogation signal, and wherein the plurality of selectively energizable illumination devices, when energized simultaneously, emit electromagnetic radiation which interferes in the operation of at least one of the plurality of selectively actuated electromagnetic radiation detection devices, and enhances a contrast, as the individual items pass through the inspection station.

2. The method of sorting of claim 1 and further comprising:

providing a controller for selectively energizing the plurality of illumination sources in a predetermined order, and for predetermined durations of time, and in predetermined wavelength spectrums, and in real time, so that the selectively actuated electromagnetic radiation detection devices receive the selective electromagnetic radiation and responsively generate the interrogation signals.

3. The method of sorting of claim 2 and further comprising:

acquiring, and communicating, the interrogation signals from the plurality of selectively actuated electromagnetic radiation detection devices to the controller.

4. The method of sorting of claim 3 and further comprising:

analyzing, with the controller, the acquired interrogation signals and identifying the interferences within the respective interrogation signals.

5. The method of sorting of claim 4 and further comprising:

optimizing, with the controller, the interference, to increase the contrast between the multitude of characteristics of the individual items.

6. The method of sorting of claim 5 and further comprising:

detecting and identifying the multitude of characteristics of the individual items passing through the inspection station by forming a real-time, multiple-aspect representation of the individual items with the controller by utilizing the increased contrast provided by the optimized interferences.

7. The method of sorting of claim 6 and further comprising:

sorting the individual items passing through the inspection station based, at least in part, upon the multiple aspect representation formed by the controller, as the individual items pass through the inspection station.

8. The method of sorting of claim 2 and further comprising:

providing a background illumination source in the inspection station and aligning the background illumination source along the single focal plane and wherein the background illumination source, when selectively energized by the controller, emits electromagnetic radiation for predetermined durations of time and in predetermined wavelength spectrums, so that the selectively actuated electromagnetic radiation detection devices receive the electromagnetic radiation from the selectively energized background illumination source, and the electromagnetic radiation from the selectively energized background illumination source and a foreground illumination source corresponds to the interference.

9. The method of sorting of claim 8 wherein the selective energizing of the background for the predetermined durations of time partially temporally overlaps the selective energizing of at least one illumination source and the selective actuation of at least one electromagnetic radiation detection device.

10. The method of sorting of claim 8 wherein the selective energizing of the background for the predetermined durations of time completely temporally overlaps the selective energizing of at least one illumination source and the selective actuation of at least one electromagnetic radiation detection device.

11. The method of sorting of claim 8 wherein the selective energizing of the background for the predetermined durations of time does not temporally overlap the selective energizing of at least one illumination source and the selective actuation of at least one electromagnetic radiation detection device.

12. The method of sorting of claim 8 wherein the selective energizing of multiple foreground illumination sources for the predetermined durations of time partially temporally overlaps the selective energizing of at least one illumination source and the selective actuation of at least one electromagnetic radiation detection device.

13. The method of sorting of claim 8 wherein the selective energizing of multiple foreground illumination sources for the predetermined durations of time completely temporally overlaps the selective energizing of at least one illumination source and the selective actuation of at least one electromagnetic radiation detection device.

14. The method of sorting of claim 8 wherein the selective energizing of multiple foreground illumination sources for the predetermined durations of time does not temporally overlap the selective energizing of at least one illumination source and the selective actuation of at least one electromagnetic radiation detection device.

15. The method of sorting of claim 8 wherein the selective energizing of multiple foreground illumination sources for the predetermined durations of time partially temporally overlaps the selective energizing of the background.

16. The method of sorting of claim 8 wherein the selective energizing of multiple foreground illumination sources for the predetermined durations of time completely temporally overlaps the selective energizing of the background.

17. The method of sorting of claim 8 wherein the selective energizing of multiple foreground illumination sources for the predetermined durations of time does not temporally overlap the selective energizing of the background.

18. The method of sorting of claim 2 and further comprising:

determining a compensation that optimizes the interference and applying the determined compensation to the interference, by means of the controller, to correct the interrogation signal; and making a sorting decision based upon the corrected interrogation signal less the known interference.

19. The method of sorting of claim 2 wherein the predetermined duration of time of energizing at least one selectively energizable illumination source exceeds the predetermined duration of time of actuation of a corresponding selectively actuated electromagnetic radiation detection device so that the illumination provided by the energized illumination source is detected and received by plural electromagnetic radiation detection devices.

20. The method of sorting of claim 2 wherein the interference allows an increase in interrogation signal amplitude.

21. The method of sorting of claim 2 wherein the emitted electromagnetic radiation is synchronous.

22. The method of sorting of claim 2 wherein the emitted electromagnetic radiation is phase-aligned.

23. The method of sorting of claim 2 wherein the emitted electromagnetic radiation is collimated.

24. The method of sorting of claim 2 wherein the emitted electromagnetic radiation is polarized.

25. The method of sorting of claim 2 wherein the emitted electromagnetic radiation is diffused.

26. The method of sorting of claim 2 wherein the emitted electromagnetic radiation is multi-directional.

27. The method of sorting of claim 2 wherein the electromagnetic radiation is transmitted through the objects of interest and the selectively actuated electromagnetic radiation detectors receive the transmitted electromagnetic radiation; and the interrogation signals generated by the selectively actuated electromagnetic radiation detectors are formed from received transmitted electromagnetic radiation.

28. The method of sorting of claim 27 wherein contrast within the interrogation signals generated by the electromagnetic radiation detectors is improved by detecting a polarization response.

29. The method of sorting of claim 2 wherein the electromagnetic radiation is reflected by the objects of interest and the electromagnetic radiation detectors receive the reflected electromagnetic radiation; and the interrogation signals generated by the electromagnetic radiation detectors are formed from received reflected electromagnetic radiation.

30. The method of sorting of claim 29 wherein contrast within the interrogation signals generated by the electromagnetic radiation detectors are improved by detecting a polarization response.

31. The method of sorting of claim 2 and further comprising:

initiating a predetermined synchronous phase aligned interference between selectively energized illumination sources and the selectively actuated electromagnetic radiation detection devices.

32. The method of sorting of claim 2 and further comprising:

optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

33. A method of sorting comprising:

providing a source of a product to be sorted, which includes of a plurality of individual items each having a multitude of internal and external characteristics, and wherein the multitude of internal and external characteristics are selected from a group including color; light polarization; light fluorescence; light reflectance; light scatter; light transmittance; light absorbance; surface texture; translucence; density; composition; structure and constituents, and wherein the multitude of internal and external characteristics can be detected and identified, at least in part, with electromagnetic radiation which is spectrally reflected, refracted, fluoresced, emitted, absorbed, scattered or transmitted by the multitude of internal and external characteristics of each of the plurality of individual items;

conveying the plurality of individual items along a path of travel, and through an inspection station, and selectively illuminating and irradiating the plurality of individual items with electromagnetic radiation and contemporaneously collecting the electromagnetic radiation which is reflected, refracted, fluoresced, emitted, absorbed, scattered and/or transmitted from or by each of the plurality of individual items;

providing a plurality of selectively energizable illumination sources and orienting the illumination sources along a single focal plane within the inspection station, and selectively energizing the illumination sources so that the selectively energized illumination sources emit electromagnetic radiation that illuminates and irradiates the individual items passing through the inspection station;

providing a plurality of selectively actuated electromagnetic radiation detection devices, and positioning the respective electromagnetic radiation detection devices along the single focal plane within the inspection station, and collecting the electromagnetic radiation which is reflected, refracted, fluoresced, emitted, absorbed, scattered and/or transmitted from or by each of the plurality of individual items passing through the inspection station, and wherein each of the plurality of selectively actuated electromagnetic radiation detection devices, upon collection of the electromagnetic radiation, generates an interrogation signal, and wherein the plurality of selectively energizable illumination devices, when energized simultaneously, emit electromagnetic radiation which interferes in the operation of at least one of the plurality of selectively actuated electromagnetic radiation detection devices, and enhances a contrast as the individual items pass through the inspection station;

providing a controller for selectively energizing the plurality of selectively energizable illumination sources in a predetermined order, and for predetermined durations of time, and in predetermined wavelength spectrums, and in real time, so that the selectively actuated electromagnetic radiation detection devices receive the electromagnetic radiation and responsively generate the interrogation signals;

acquiring, and communicating, the interrogation signals from the plurality of selectively actuated electromagnetic radiation detection devices to the controller;

analyzing, with the controller, the acquired interrogation signals and identifying the interference within the respective interrogation signals;

optimizing, with the controller, the interference, to increase the contrast between the multitude of internal and external characteristics of the individual items;

detecting and identifying the multitude of internal and external characteristics of the individual items passing through the inspection station by forming a real-time, multiple-aspect representation of the individual items with the controller by utilizing the increased contrast provided by the optimized interference; and sorting the individual items passing through the inspection station based, at least in part, upon the multiple aspect representation formed by the controller, as the individual items pass through the inspection station.

34. The method of sorting of claim 33 and wherein the contrast within the interrogation signal generated by the selectively actuated electromagnetic radiation detection device is improved by detecting a polarization response.

35. The method of sorting of claim 33 and further comprising:

providing a background illumination source in the inspection station and aligning the background illumination source along the single focal plane and wherein the background illumination source, when selectively energized by the controller, emits electromagnetic radiation for predetermined durations of time and in predetermined wavelength spectrums, so that the selectively actuated electromagnetic radiation detection devices receive the electromagnetic radiation from the selectively energized background illumination source, and the electromagnetic radiation from the selectively energized background illumination source and a foreground illumination source corresponds to the interference.

36. The method of sorting of claim 33 further comprising: multiple foreground illumination sources, and wherein the selective energizing of the multiple foreground illumination sources for the predetermined durations of time partially temporally overlaps the selective energizing of at least one illumination source and the selective actuation of at least one electromagnetic radiation detection device.

37. The method of sorting of claim 33 further comprising: multiple foreground illumination sources, and wherein the selective energizing of the multiple foreground illumination sources for the predetermined durations of time completely temporally overlaps the selective energizing of at least one illumination source and the selective actuation of at least one electromagnetic radiation detection device.

38. The method of sorting of claim 33 and further comprising:

determining a compensation that optimizes the interference and applying the determined compensation to the interference, by means of the controller, to address the interference; and making a sorting decision based upon the interrogation signal less the known interference.

39. The method of sorting of claim 33 wherein the interference allows an increase in interrogation signal amplitude.

40. The method of sorting of claim 33 wherein the emitted electromagnetic radiation is synchronous.

41. The method of sorting of claim 33 wherein the emitted electromagnetic radiation is phase-aligned.

42. The method of sorting of claim 33 wherein the emitted electromagnetic radiation is collimated.

43. The method of sorting of claim 33 wherein the emitted electromagnetic radiation is polarized.

44. The method of sorting of claim 33 wherein the emitted electromagnetic radiation is diffused.

45. The method of sorting of claim 33 wherein the emitted electromagnetic radiation is multi-directional.

46. The method of sorting of claim 33 wherein the electromagnetic radiation is transmitted through the objects of interest and the selectively actuated electromagnetic radiation detectors receive the transmitted electromagnetic radiation; and the interrogation signals generated by the selectively actuated electromagnetic radiation detector are formed from received transmitted electromagnetic radiation.

47. The method of sorting of claim 46 wherein contrast within the interrogation signals generated by the electromagnetic radiation detectors is improved by detecting a polarization response.

48. The method of sorting of claim 33 wherein the electromagnetic radiation is reflected by the objects of interest and the electromagnetic radiation detectors receive the reflected electromagnetic radiation; and the interrogation signals generated by the electromagnetic radiation detectors are formed from received reflected electromagnetic radiation.

49. The method of sorting of claim 48 wherein contrast within the interrogation signals generated by the electromagnetic radiation detectors is improved by detecting a polarization response.

50. The method of sorting of claim 33 and further comprising:

initiating a predetermined synchronous phase aligned interference between selectively energized illumination sources and the selectively actuated electromagnetic radiation detection devices.

51. The method of sorting of claim 33 and further comprising:

optimizing the predetermined durations of time of actuation for the respective electromagnetic radiation detection devices utilizing the interference between selectively energized illumination sources and the selectively actuated electromagnetic radiation detection devices; and delivering the interrogation signals generated by the respective actuated electromagnetic radiation detection devices to the controller.

* * * * *